US005598194A

United States Patent [19]

Hall et al.

[11] Patent Number: 5,598,194

[45] Date of Patent: * Jan. 28, 1997

[54] WIPING STRUCTURE FOR CLEANING ELECTRICAL CONTACTS FOR A PRINTER AND INK CARTRIDGE

[75] Inventors: Corrina A. E. Hall; W. Wistar Rhoads, both of Escondido; Patricia S. Brown, Encinitas; Arthur K. Wilson, San Diego, all of Calif.

[73] Assignee: Hewlett-Packard Company, Palo Alto, Calif.

[ * ] Notice: The term of this patent shall not extend beyond the expiration date of Pat. No. 5,461,482.

[21] Appl. No.: 56,009

[22] Filed: Apr. 30, 1993

[51] Int. Cl.[6] ..... B41J 2/01

[52] U.S. Cl. ..... 347/50; 439/67

[58] Field of Search ..... 346/1.1, 139 R, 346/139 C, 140 R; 400/175, 352, 692; 439/66, 67, 492, 493; 347/50, 49

[56] References Cited

U.S. PATENT DOCUMENTS

| | | | |
|---|---|---|---|
| 3,787,880 | 1/1974 | Kattner et al. | 347/49 |
| 3,881,195 | 4/1975 | Ono et al. | 360/128 |
| 4,586,056 | 4/1986 | Okamura et al. | 346/139 C X |
| 4,630,078 | 12/1986 | Watanabe | 347/50 X |
| 4,633,274 | 12/1986 | Matsuda | 347/50 |
| 4,635,080 | 1/1987 | Watanabe | 347/50 |
| 4,706,097 | 11/1987 | Harmon | 346/139 R |
| 4,758,849 | 7/1988 | Piatt et al. | 347/9 |
| 4,872,026 | 10/1989 | Rasmussen et al. | 346/140 R |
| 5,194,015 | 3/1993 | Yamamoto et al. | 439/492 X |
| 5,227,959 | 7/1993 | Rubinstein et al. | 439/66 X |
| 5,461,482 | 10/1995 | Wilson et al. | 347/50 |

FOREIGN PATENT DOCUMENTS

| | | |
|---|---|---|
| 0255687A3 | 7/1987 | European Pat. Off. . |
| 0313205A3 | 9/1988 | European Pat. Off. . |
| 0376719A3 | 12/1989 | European Pat. Off. . |
| 0418817A1 | 9/1990 | European Pat. Off. . |
| 63-234942 | 10/1987 | Japan . |

*Primary Examiner*—Joseph W. Hartary

[57] ABSTRACT

An apparatus and method for providing proper electrical contact between corresponding interconnect pads of a print cartridge and a print carriage are disclosed. One end of a flex circuit having interconnect pads of the print carriage is attached to one side of the print carriage while the other end of the flex circuit may be substantially free or attached to an opposing side of the print carriage. When the print cartridge is initially inserted into the print carriage, a gimbal spring causes the flex circuit interconnect pads to preliminarily come in contact with the print cartridge interconnect pads before the print cartridge is completely inserted. As the print cartridge is further inserted, the print cartridge pushes out any excess slack in the flex circuit while providing a wiping action between the interconnect pads of the print cartridge and the flex circuit. This wiping action between the interconnect pads scrapes away any contaminants and corrosion, thus ensuring reliable electrical contact.

17 Claims, 16 Drawing Sheets

WIPING STRUCTURE FOR CLEANING ELECTRICAL CONTACTS FOR A PRINTER AND INK CARTRIDGE

CROSS REFERENCE TO RELATED APPLICATIONS

This application is related to and incorporates by reference the following U.S. patent applications filed on the same date as the present application and assigned to the same assignee as the present application: the application entitled "Datum Machining Structure for Alignment of Printheads" filed by Jeff A. Thoman et al., U.S. Ser. No. 08/056,556 filed Apr. 30, 1993, now U.S. Pat. No. 5,408,746; the application entitled "Reliable Contact Pad Arrangement on Plastic Print Cartridge" filed by W. Bruce Reid, U.S. Ser. No. 08/055,617 filed Apr. 30, 1993; the application entitled "Side Biased Datum Scheme for Inkjet Cartridge and Carriage" filed by David W. Swanson et al., U.S. Ser. No. 08/057,241 filed Apr. 30, 1993; the application entitled "Electrical Interconnect System for a Printer" filed by Arthur K. Wilson et al., U.S. Ser. No. 08/056,345 filed Apr. 30, 1993, now Pat. No. 5,461,482, and the application entitled "Method and Device for Preventing Unintended Use of Print Cartridge Families" filed by Jeff A. Thoman et al., U.S. Ser. No. 08/056,961 filed May 3, 1993, now U.S. Pat. No. 5,519,422.

BACKGROUND

1. Field of the Invention

The present invention relates generally to printers and, more particularly, to a method and apparatus for ensuring good electrical contact between interconnect pads on a print cartridge and the corresponding interconnect pads in the stall of a print carriage.

2. Related Art

Inkjet printheads operate by ejecting a droplet of ink through a nozzle and onto a recording medium, such as a sheet of paper. When a number of nozzles are arranged in a pattern, such as a rectangular matrix, the properly sequenced ejection of ink from each nozzle causes characters or other images to be printed on the paper as the printhead is moved relative to the paper. The printhead is usually part of a disposable print cartridge containing a supply of ink. The print cartridge is designed for easy installation and removal from a stall in a print carriage. Print cartridges are installed and removed hundreds of times over the life of a print carriage.

In one type of thermal inkjet print cartridge, the print cartridge includes: 1) an ink reservoir and ink channels to supply ink proximate to each of the nozzles; 2) a printhead in which the nozzles are formed in a desired pattern; 3) a substrate attached to a bottom surface of the printhead, a series of thin film heater resistors being formed on the substrate, generally one resistor below each nozzle and 4) interconnect pads formed on an insulating tape with which electrical connections are made to corresponding interconnect pads on the print carriage.

To print a dot of ink from a nozzle, an electrical current is passed through paired interconnect pads of the print carriage and the print cartridge to a selected resistor of the print cartridge. The heater is ohmically heated, in turn heating a thin layer of adjacent ink. This results in vaporization of the ink, vapor bubbles in the ink causing a droplet of ink to be ejected through an associated nozzle onto the paper. The resistors in the substrate are connected by conductors formed on the insulating tape to interconnect pads on the insulating tape. The interconnect pads, the conductors and the insulating tape are collectively known as the TAB circuit, since the insulating tape is bonded to the printhead by the well-known tape automated bonding (TAB) process.

There are several problems associated with the prior art devices that result in inadequate electrical contact between corresponding interconnect pads. In the prior art, the interconnect pads of the print carriage were terminal points of a circuit formed on a flexible insulating tape (also known as a "flex" circuit). Previously, the flexible insulating tape was mounted on the print carriage so that the interconnect area was over-constrained. FIG. 1 is a schematic of a cross-sectional view of a flexible insulating tape 87 in which two opposite ends 91 and 92 are attached to print carriage 30.

One reason for inadequate electrical contact between interconnect pads is that, with multiple sides attached to the print carriage 30, the flexible insulating tape 87 is overconstrained causing non-uniform deflection of the tape 87 when a contact force F is applied to the tape 87. As shown in FIG. 1, the flexible insulating tape 87 buckles when the contact force F is applied. Buckling results in inadequate contact between some of the interconnect pads of the print carriage and the print cartridge since not all of the interconnect pads on the tape 87 are deflected the same amount.

Another reason for inadequate electrical contact between corresponding interconnect pads is the need for each interconnect pad of print cartridge 24, 25, 26 or 27 to be positioned precisely with respect to each interconnect pad in the carriage stall of print carriage 30. Inadequate positioning of corresponding interconnect pads due to non-uniformity in height of the interconnect pads (henceforth also "flatness" problem) may result in "missing dots" due to inadequate contact. In the prior art, the flex circuit had bumps on one side and dimples on the other side. The interconnect pads were formed on the bumps of the flex circuit. The flex circuit was supported by an elastomeric pad that had columns on opposing sides.

One prior art elastomeric pad is described in U.S. Pat. No. 4,706,097 to Harmon. As shown in FIG. 3A of U.S. Pat. No. 4,706,097 to Harmon, tips of columns of the elastomeric pad facing the flex circuit are inserted into the dimples on the flex circuit. The columns of the elastomeric pad act to push the interconnect pads of the flex circuit into contact with corresponding interconnect pads of the TAB circuit. Because of the deformability of the elastomeric material, columns of the elastomeric pad also act to compensate for localized minor variations in height of the interconnect pads on the flex circuit or the TAB circuit.

One problem with the prior art elastomeric pad is that the height of the columns on the side opposite the side facing the flex circuit that is necessary to ensure adequate contact force results in long column buckling or bending of the columns. Long column buckling results in inadequate contact between corresponding interconnect pads since a bent column does not exert the necessary minimum contact force.

Another problem with the prior art elastomeric pad is that the spring characteristics of the columns require tight control of the relative positions of the print cartridge and the print carriage. Tight control is necessary because a small variation in displacement (i.e., change in relative positions of the print carriage and print cartridge) results in a large variation in contact force.

Also, as shown in FIG. 2 of U.S. Pat. No. 4,706,097 to Harmon, a relatively large variation of displacement delta, $\Delta$ results in large variation in load $L_1$ between the interconnect pads. If the flex circuit interconnect pad is displaced too far, the load may become great enough to damage the interconnect pads. On the other hand, if the displacement drops below delta Δ, the load drops below $L_1$ resulting in inadequate electrical contact between the interconnect pads of the flex circuit and TAB circuit.

Moreover, in order to ensure proper electrical contact, the print cartridge must be positioned in the print carriage so that the corresponding interconnect pads on the flex circuit and TAB circuit are positioned in parallel planes. If the print cartridge is aligned at an angle with respect to the print carriage, there is a wide variation in contact forces between some pairs of interconnect pads. Consequently, some interconnect pads may be damaged, or there may be inadequate electrical contact between some pairs of pads. The prior art elastomeric pad was unable to compensate for such misalignment.

Also, in order to have proper contact between the interconnect pads it is necessary for each print cartridge 24–27 and each carriage stall to be relatively clean. Presence of residual hot melt, dried ink, package shavings or small fibers can result in contamination failures. Any contamination, such as a 3 mil diameter piece of skin, caught between the interconnect pads results in improper contact which results in the "missing dots" problem. In the prior art, to ensure clean surfaces, a cleaning brush or a Q-tip swab® applicator was used to brush away the contaminants. The drawback with this technique is that the Q-tip swab® applicator itself left fibers which in turn caused contamination failures of the interconnect pads.

Reliability of contact between interconnect pads can also be improved by increasing the force of contact between the interconnect pads. However, there are several problems associated with increasing the contact force in the prior art device. For example, a large increase in contact force may damage the interconnect pads on the print carriage. Also, if the print cartridge is inserted at an angle, the farthest interconnect pads are subjected to a greater force so that the maximum load is limited to what the farthest interconnect pads can withstand. Another problem is that since the interconnect pads of the print carriage are formed on a flexible insulating tape supported by an elastomeric pad that has bumps, increasing the contact force results in buckling of the bumps of the elastomeric pad.

Furthermore, in the prior art, when the print cartridge was inserted into the print carriage, a small radius rotary motion between the print cartridge and print carriage was used to bring the corresponding interconnect pads into contact with each other. The prior art rotary motion is described in detail in U.S. Pat. No. 4,872,026 to Rasmussen et al.

Finally, if the properties of the elastomeric pad were changed to solve one of the above problems, such a change adversely affected the other problems so that all the problems could not be addressed simultaneously by the prior art elastomeric pad.

Thus, there is a need for an inexpensive and reliable method and structure for improving the electrical contact between the interconnect pads on a print cartridge and the corresponding interconnect pads in the stall of a print carriage.

SUMMARY OF THE INVENTION

According to the invention, adequate electrical contact between interconnect pads on a print cartridge and interconnect pads on a print carriage is achieved while reducing the incidence of damage to the interconnect pads.

The invention includes a flexible insulating tape on which interconnect pads are formed at terminal points of electrically conductive traces formed in a tape ("flex circuit"). In one embodiment, only one end of the flexible insulating tape is attached to the print carriage. In another embodiment, one end of the flexible insulating tape is mounted on one side of the print carriage and the other end is mounted on an opposing side of the print carriage, the flexible insulating tape bending around an end of a portion of the print carriage.

Proper electrical contact between interconnect pads of the print cartridge and interconnect pads of the print carriage stalls is also achieved by providing a wiping action between the interconnect pads during installation of the print cartridge in each print carriage stall.

A gimballed structure in the print carriage causes the interconnect pads to preliminarily come in contact before the print cartridge is completely inserted into the print carriage in spite of an angular disposition between the print cartridge and the print carriage. Further insertion of the print cartridge is achieved via rotation around a moving pivot point due to the geometric shapes of the print cartridge and the print carriage. During insertion, any excess slack in the flexible insulating tape is pushed out by the print cartridge. As the print cartridge is moved into its final position in the print carriage, a significant amount of sliding motion between the interconnect pads causes wiping of the pads. This wiping action between the interconnect pads scrapes away any contaminants and corrosion, thus ensuring reliable electrical contact between corresponding interconnect pads on the print carriage and the print cartridge.

In one embodiment, the interconnect pads of the print cartridge are made of a softer material while the interconnect pads of the print carriage are made of a harder material so that the interconnect pads of the disposable print cartridge are worn out first.

DETAILED DESCRIPTION OF THE PREFERRED EMBODIMENT

Figure 1:
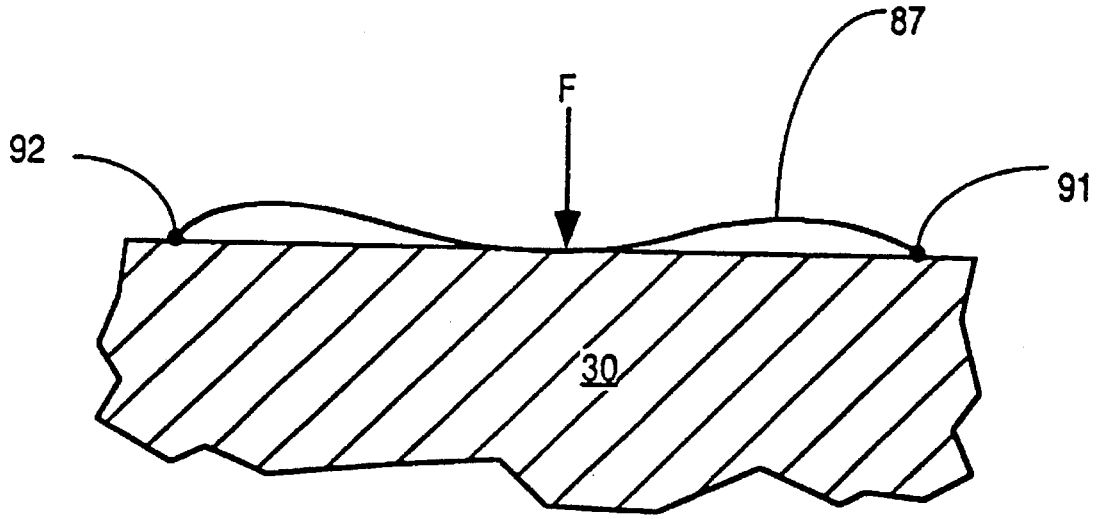
FIG. 1 PRIOR ART
FIG. 1 is a schematic of a cross-sectional view of a flexible insulating tape in which two opposite ends are attached to the print carriage.

This invention provides adequate electrical contact between interconnect pads of a print cartridge and interconnect pads of a print cartridge. The interconnect pads of the print cartridge are formed on a flexible insulating tape at terminal points of electrically conductive traces formed in the tape ("flex circuit"). In one embodiment, one end of the flexible insulating tape is mounted on one side of the print carriage and the other end is mounted on an opposing side of the print carriage, the flexible insulating tape bending around an end of a portion of the print carriage.

This invention also includes an elastomeric compensator that has columns with hemispherical domes formed on a side that faces the flexible insulating tape to compensate for localized variations in the heights of the interconnect pads of the print carriage. The domes of columns of the compensator are inserted into corresponding dimples formed in the flexible insulating tape at the location of each interconnect pad. The height to diameter ratio of each column is low enough that buckling of the columns is minimized or eliminated.

This invention also includes a floating gimbal plate and a spring. The plate is forced by the spring against stops of the print carriage such that the plate can gimbal with respect to the spring. The spring and plate together apply a sufficient force through the elastomeric compensator and the flex circuit interconnect pads to the interconnect pads on the print cartridge so that adequate electrical contact is obtained.

The spring, plate and elastomeric compensator allow a global redistribution of force on the interconnect pads so that, if the plane of the print cartridge interconnect pads is at an angle with respect to the plane of the flex circuit interconnect pads, the spring, the plate, and the elastomeric compensator help to equalize the force exerted on each print cartridge interconnect pad. The spring is pre-loaded and has a relatively small spring constant so that the force supplied remains approximately constant through a relatively large displacement of the flex circuit.

In accordance with this invention, when the print cartridge is initially inserted into the print carriage, any excess slack in the flex circuit is pushed out in to a bend around an end of a portion of the print carriage. The interconnect pads of the print cartridge preliminarily come in contact with the flex circuit before the print cartridge is completely inserted into the print carriage. The gimbal plate and spring under the flex circuit cause the flex circuit to rock over and make contact with the interconnect pads of the print cartridge in spite of an angular disposition between the print cartridge and the print carriage. Further insertion of the print cartridge results in a significant amount of sliding between the interconnect pads on the print cartridge and flex circuit, respectively, which results in wiping of the pads. The large amount of wiping action scrapes away most contaminants and corrosion, thus ensuring reliable electrical contact. The above described aspects of this invention are described in further detail below. Although the following description refers to a color printer, numerous variations are possible.

Figure 2A:
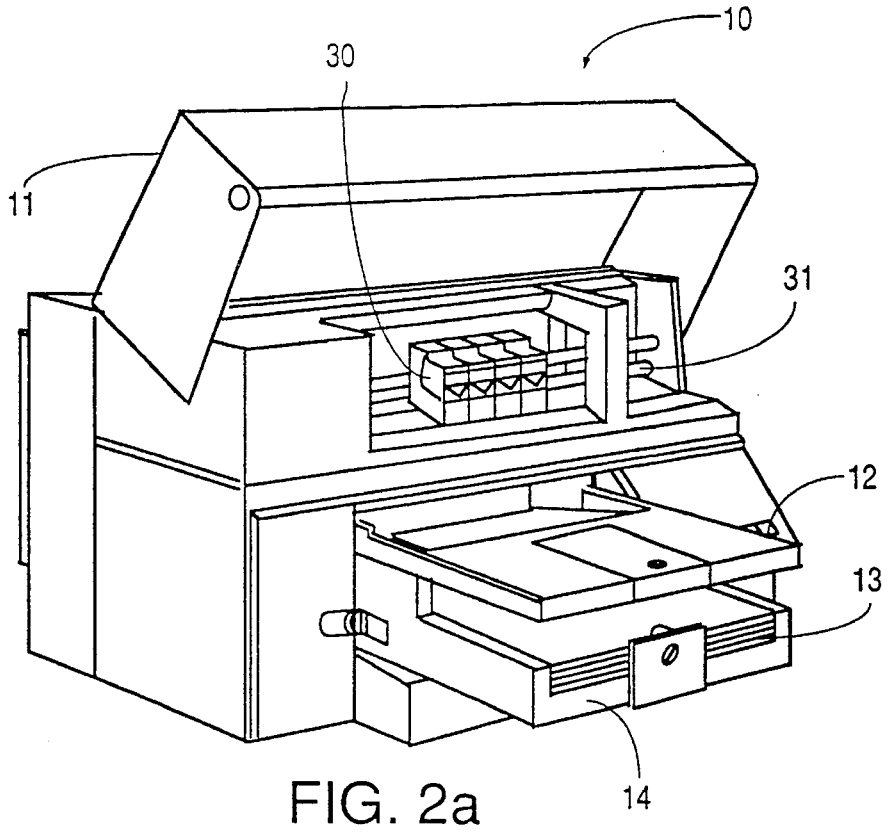
FIG. 2*a* is a perspective view of a color printer in accordances with this invention.

FIG. 2*a* is a perspective view of a printer in accordance with this invention. As shown in FIG. 2*a*, a desktop printer 10 includes a print carriage 30 that rides on a slide rod 31. An input tray 14 is shown loaded with paper in media stack 13 for printing of images. The printed paper is output in output tray 12. During normal operation, the protective front access lid 11 is shut so that print carriage 30 is not exposed.

Figure 2B:
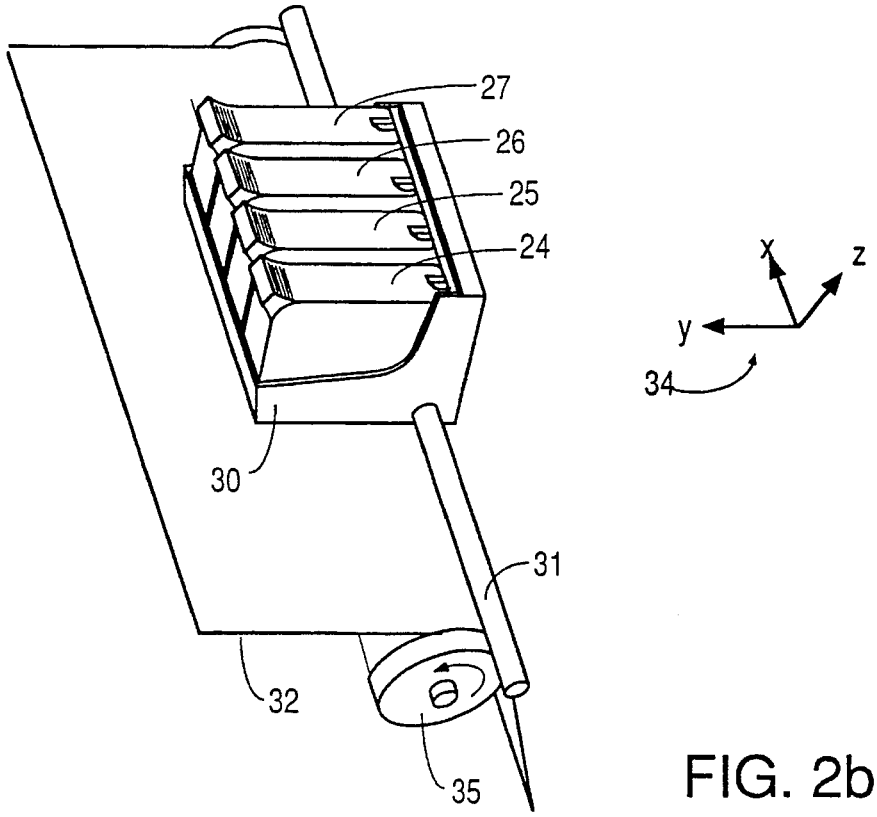
FIG. 2*b* is a perspective view of a print carriage disposed adjacent a print medium.

FIG. 2*b* is a perspective view of a print carriage 30 disposed adjacent a print medium 32 (e.g., a sheet of paper). Four separate print cartridges 24, 25, 26 and 27 are shown mounted in separate stalls of the print carriage 30. Illustratively, one of the four cartridges 24, 25, 26 or 27 contains black ink, another contains cyan ink, another contains magenta ink, and another contains yellow ink. Other numbers of print cartridges and different colors of ink can be used, e.g., three print cartridges, each containing red, green or blue ink. Each of the print cartridges 24, 25, 26 and 27 is constructed as described below with respect to FIGS. 3*a*, 3*b* and 3*c*.

As shown in FIG. 2b, print carriage 30 may be moved along stationary rod 31 back and forth across the print medium 32 along the a is defined shown by the arrow X of the coordinate system 34 (X axis is known as the carriage scan axis). A roller 35 advances the position of print medium 32 in the Y direction (Y axis is known as the media advance axis) as necessary. Ink drops are ejected from nozzles formed in the print cartridge 24, 25, 26 or 27 (as described below with respect to FIG. 3*a*) in the negative Z direction (Z axis is known as the drop trajectory axis). Coordinate system 34 is used consistently in the figures throughout this description.

Figure 2C:
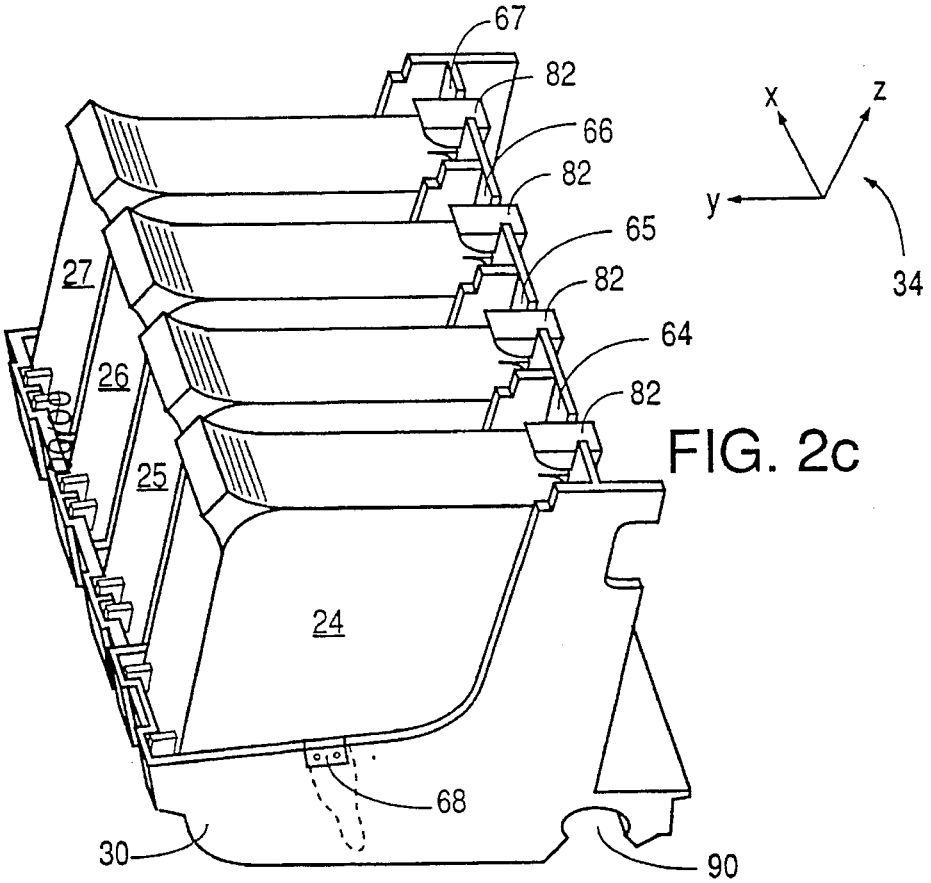
FIG. 2*c*, is a perspective view of the print carriage of FIG. 2*b* including four print cartridges.
Figure 2D:
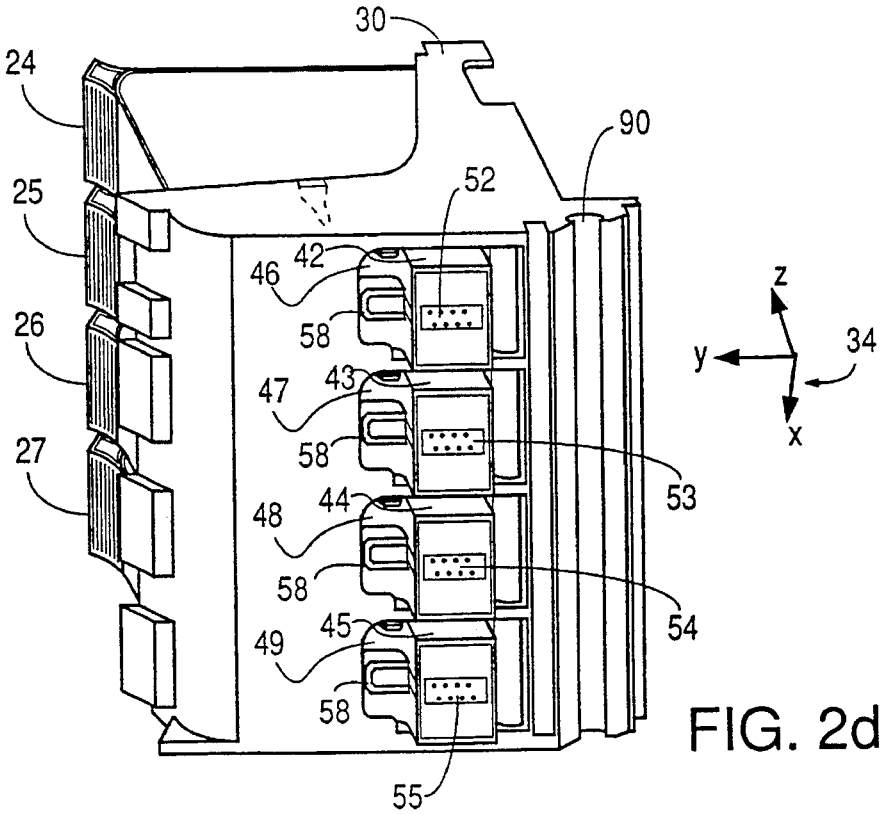
FIG. 2*d* is another perspective view of the print carriage of FIG. 2*c*.

FIG. 2*c* is a perspective view of print carriage 30 of FIG. 2*a* including four print cartridges 24, 25, 26 and 27 print carriage 30 is provided with a rod receiving recess 90 for receiving rod 31 (FIG. 2*a*) to enable print carriage 30 to be moved along the X axis of the coordinate system 34. Print carriage 30 has four stalls 64, 65, 66 and 67 (better shown in FIG. 4*a*) for receiving a corresponding print cartridge 24, 25, 26 and 27. As seen in FIG. 2*d*, each of stalls 64, 65, 66, and 67, has a rectangular opening 46, 47, 48 or 49 respectively through which a snout portion 42, 43, 44 or 45, respectively, of the print cartridge 24, 25, 26 or 27 extends. Each of the print cartridges 24, 25, 26 and 27 has a projection (FIG. 8*a*) formed on the print cartridge housing 60 (FIG. 3*d*), which is contacted by a resilient arm 82 protruding from a surface of each of stalls 64, 65, 66 and 67 to urge the corresponding print cartridge 24 25, 26 or 27 against the print carriage 30 to secure print cartridge 24, 25, 26 or 27 in place. The insertion of each of the print cartridges 24, 25, 26 and 27 into a corresponding stall 64, 65, 66 or 67 is described in detail below in reference to FIGS. 8*a*, 8*b*, 8*c* and 8*d*.

FIG. 2*d* is another perspective view of carriage 30 of print FIG. 2c. The snout portions 42, 43, 44, and 45 of print cartridges 24, 25, 26 and 27, respectively, are shown protruding through openings 46, 47, 48, and 49, respectively, in print carriage 30. Print heads 52, 53, 54, and 55 are affixed to snouts portions 42, 43, 44, and 45, respectively. Datum 124 (FIG. 4*b*) is not shown in FIG. 2*d* for clarity.

Figure 3A:
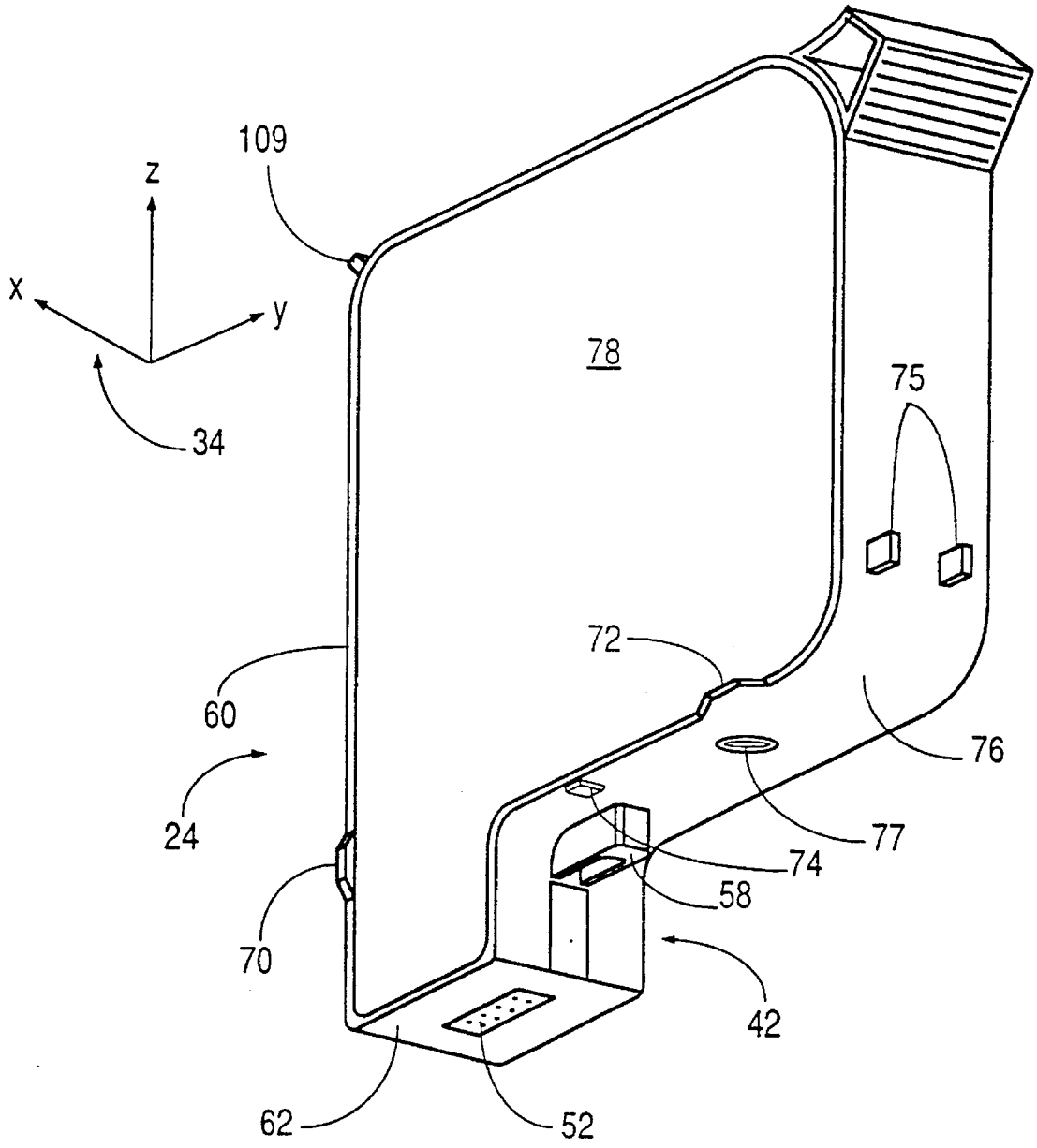
FIG. 3*a* is a perspective view of a print cartridge used in the print carriage of FIGS. 2*b*–2*d*.

FIG. 3*a* is a perspective view of print cartridge 24. It is to be understood that the other print cartridges 25, 26, 27 are similar in structure to print cartridge 24 shown in FIGS. 3*a* , 3*b* and 3*c*. As shown in FIG. 3*a* , print cartridge 24 has a housing 60 which acts as an ink reservoir. Housing 60 includes a side wall 78 and a portion 76. An ink fill-hole 77 is formed in portion 76 for filling the print cartridge 24 with ink. Side wall 78 can be made of metal. Portion 76 is made, for instance, of plastic.

As shown in FIG. 3*a* , portion 76 is provided with projections 70, 72, 74, 80 (FIG. 8*a*), 58 and 109 formed integrally with the portion 76 of housing 60. The projections 70, 72, 74, 80 and 58 precisely align the print cartridge 24 within print carriage 30 as described in detail in the aforementioned U.S. patent application entitled "Datum Machining Structure for Alignment of Printheads", Attorney Docket No. HP 1092629-1 filed Apr. 30, 1993, which is incorporated herein in its entirety. Projections 70, 72 and 109 are the X-datums which constrain the motion of the print cartridge 24 along the X-axis (carriage scan axis). Projections 58 and 80 (FIG. 8*a*) are the Y-datums that constrain the print cartridge 24 along the Y-axis (the media advance axis). For example, projection 58 is urged against a datum 124 (FIG. 4*b*) of upper wall of openings 46, 47, 48 and 49 to define the position of the print cartridge 24 along the Y axis shown by the coordinate system 34. Finally, projection 74 is the Z-datum which constrains motion along the Z-axis (the drop trajectory axis). These six datums ensure a precise kinematic contact between the print cartridge 24 and the print carriage 30 as described in detail in the aforementioned U.S. application entitled "Side Biased Datum Scheme for Inkjet Cartridge and Carriage", U.S. Ser. No. 08/057,241, filed Apr. 30, 1993, which is incorporated herein in its entirety.

Projections 75, shown in FIG. 3*a* , are formed in different patterns on portion 76 of each print cartridge 24, 25, 26, or 27 to enable different print cartridges 24, 25, 26 or 27 to be inserted into a proper corresponding stall 64, 65, 66 or 67. For example, each of the stalls 65, 66 and 67 contains a particular pattern of slots which prevent a black ink print cartridge from being inadvertently inserted into stalls 65, 66 or 67.

As shown in FIG. 3*a*, the snout portion 42 of print cartridge 24 includes a print head 52, which includes a nozzle plate typically made of a metal such as gold-coated nickel. Two parallel rows of nozzles are formed in the nozzle plate of print head 52. Print head 52 is attached by an adhesive to an underlying substrate (not shown) in which are formed heater resistors such that each heater resistor is associated with one of the nozzles.

A conventional method is used to print an image. For example, an electrical current is passed through the heater resistors which generate heat. The heat vaporizes ink adjacent the nozzles, the vapor bubbles causing ink to be ejected from the nozzle. The heater resistors are selectively heated so that ink is ejected from particular nozzles to form a desired image on a print medium adjacent the nozzles.

Figure 3B:
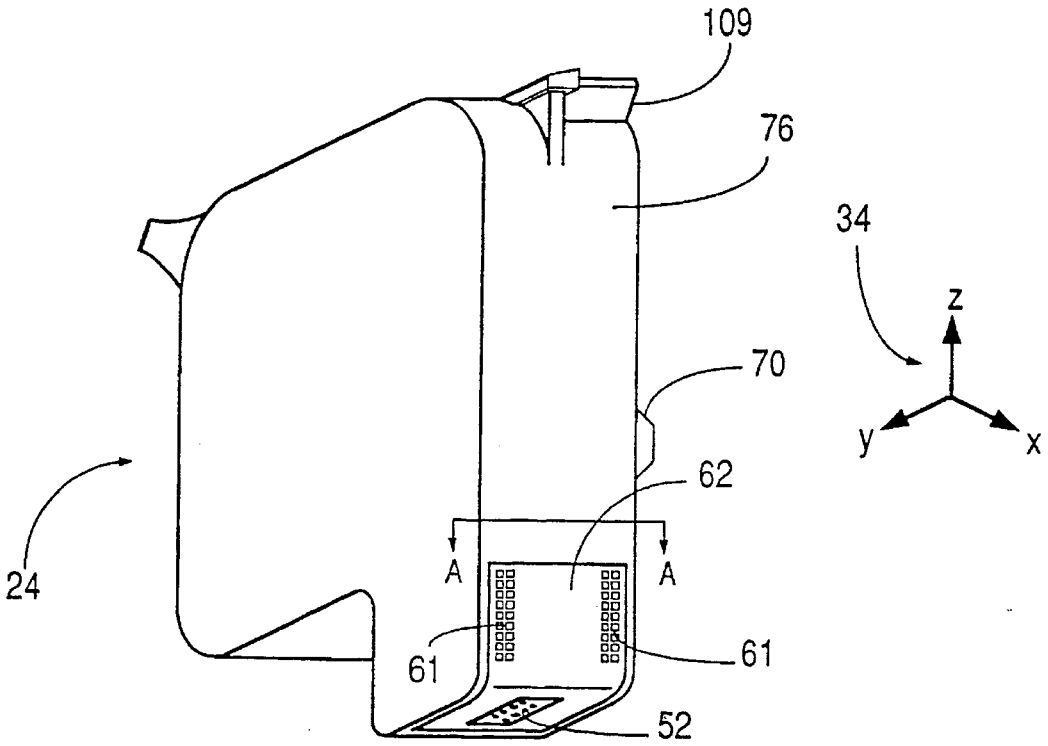
FIG. 3*b* is a perspective view of the print cartridge of FIG. 3*a* showing the interconnect pads of the print cartridge formed on insulating tape.

FIG. 3*b* is a perspective view of print cartridge 24 showing the interconnect pads 61 of print cartridge 24 formed on insulating tape 62. The interconnect pads 61 in FIG. 3*b* are square shaped, unlike the circular interconnect pads of the prior art. Moreover, the adjacent interconnect pads 61 in FIG. 3*b* are separated by the minimum distance possible to provide each interconnect pad 61 with a maximum contact area. The large contact area compensates for misalignment between the positioning of interconnect pads 61 and interconnect pads on the flex circuit in carriage 30 (described in print more detail below), while still maintaining adequate electrical contact between corresponding interconnect pads. Conductors are formed on insulating tape 62 and connect interconnect pads 61 to electrodes on the substrate underneath print head 52. The interconnect pads 61, the conductors and the electrodes on the insulating tape 62 are collectively known as the TAB circuit, since the insulating tape 62 is bonded to the print head 52 using the well known tape automated bonding (TAB) process.

Figure 3C:
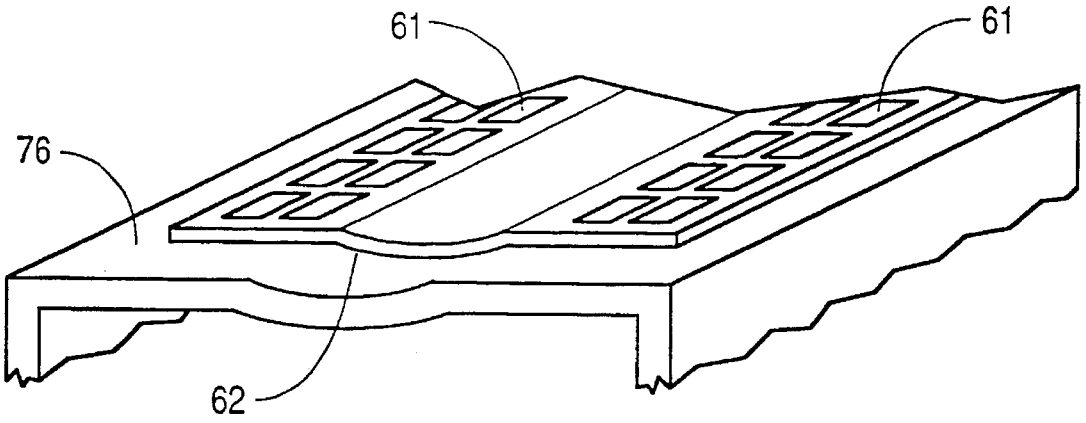
FIG. 3*c* is a perspective view along section A—A of FIG. 3*b*.

FIG. 3*c* is a perspective view along section A—A of FIG. 3*b*. As shown in FIG. 3*c*, interconnect pads 61 are formed only along the side of portion 76 since the middle section of portion 76 is prone to sinking during the injection molding process used to form portion 76. Insulating tape 62 may be glued to the portion 76 using any suitable adhesive or may be heat-staked to portion 76 at selected points on tape 62. The details of the interconnect area of the print cartridge are described in the aforementioned U.S. application entitled "Reliable Contact Pad Arrangement on Plastic Print Cartridge", U.S. Ser. No. 08/055,617 filed Apr. 30, 1993, which is incorporated herein in its entirety.

Figure 4A:
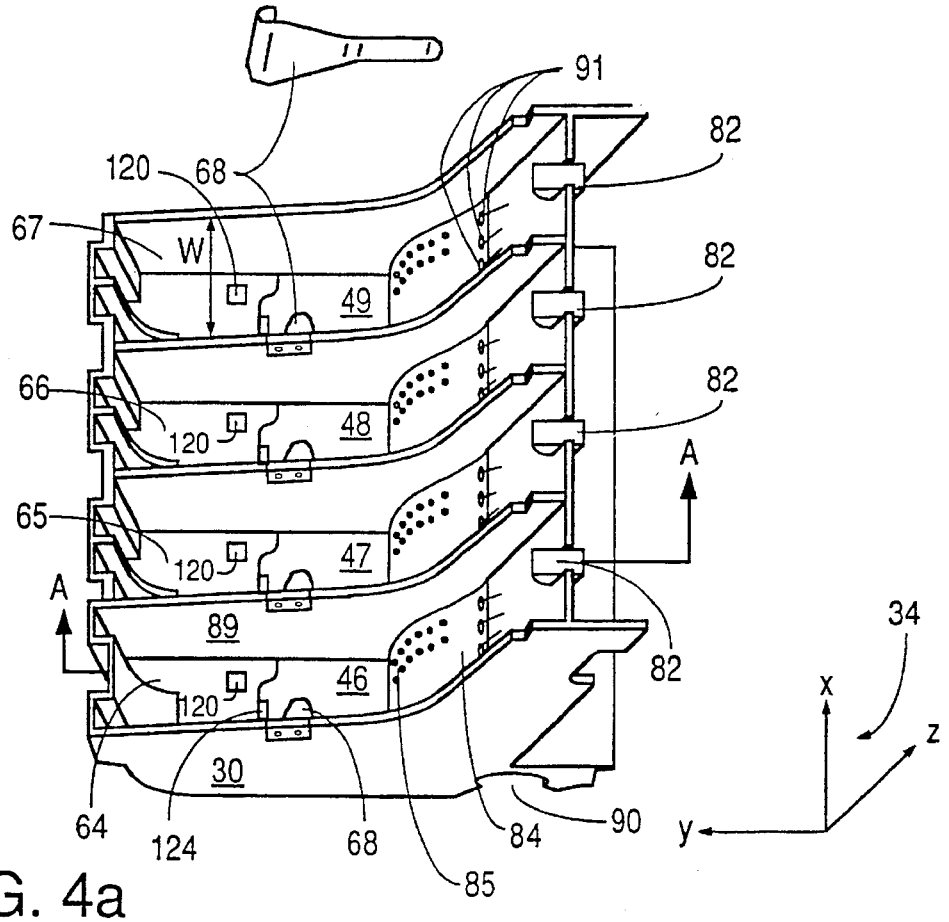
FIGS. 4*a* and 4*b* are perspective views of the print carriage of FIG. 2*b*–2*b* prior to the print cartridges being inserted.
Figure 4B:
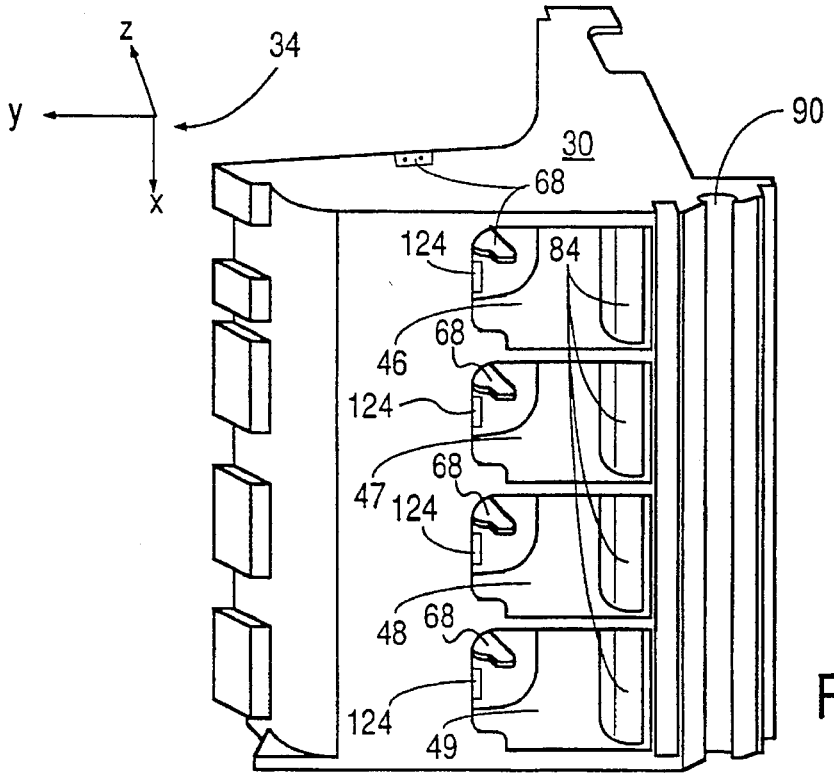

FIGS. 4*a* and 4*b* are perspective views of print carriage 30 prior to the print cartridges 24, 25, 26 and 27 being inserted. Print carriage 30 can be formed of plastic by, for instance, injection molding using conventional methods to produce a print carriage 30 with very consistent features. A resilient metal arm 68, shown in greater detail at the right of FIG. 4*a*, is provided for each stall 64, 65, 66 or 67 to urge the print cartridge 24, 25, 26 or 27, respectively against a wall 89 of the respective stall 64, 65, 66 or 67.

Figure 4C:
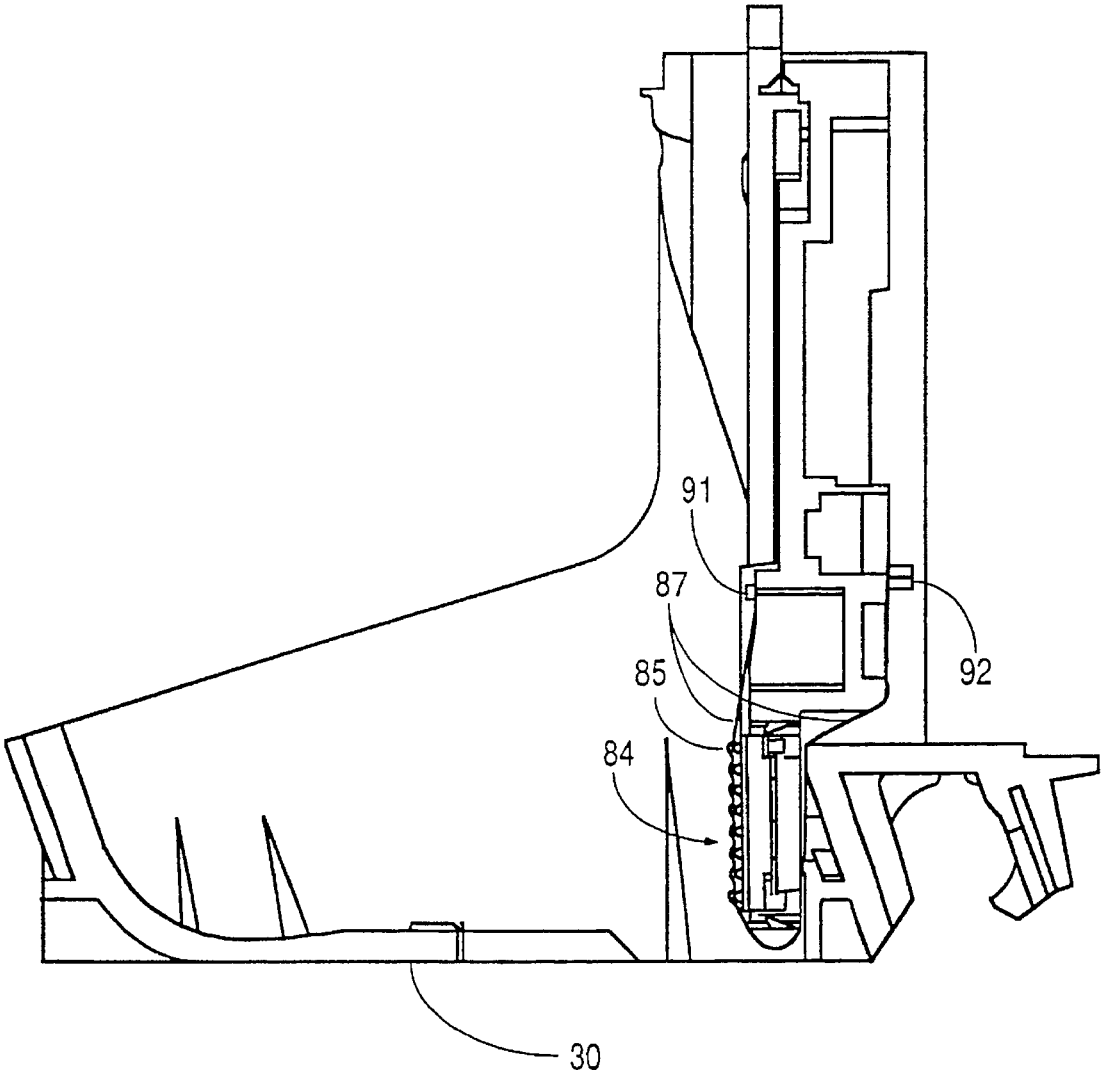
FIG. 4*c* is a cross-sectional view along section A—A of FIG. 4*a* (in the X-direction of coordinate system).

An interconnection area on the wall of each of stalls 64, 65, 66 and 67 is provided with flex circuit 84 (FIG. 4*a* ) that includes interconnect pads 85 of print carriage 30. Each of the interconnect pads 85 on the flex circuit 84 are formed at a terminal end of an electrically conductive trace formed in a flexible tape 87 (FIG. 4*c*). An electrical power supply associated with the printer selectively supplies electric current through the electrically conductive traces to the interconnect pads 85 of the flex circuit 84. By selectively transmitting electric current through the interconnect pads 85 on the flex circuit 84 to the interconnect pads 61 (FIG. 3*b*) on each of the print cartridges 24, 25, 26 and 27 (and thus, to selected ones of the resistors), ink is ejected through certain of the heater nozzles in plate 52 to form a desired image on the print medium 32.

In order to form an adequate electrical contact between the interconnect pads 85 on the flex circuit 84 and the interconnect pads 61 on the print cartridges 24, 25, 26 and 27, it is necessary to provide a minimum amount of contact force. To provide this minimum contact force, the flex circuit 84 is supported on the back by an elastomeric compensator, a gimbal plate and a spring as explained in more detail below.

If there is inadequate electrical contact between interconnect pads 61 on the print cartridge 24, 25, 26 or 27 and corresponding interconnect pads 85 on the print carriage 30, one or more heater resistors cannot be heated so that one or more nozzles in plate 52 cannot eject ink. If even a single pair of interconnect pads 61 and 85 are not in proper contact, up to eight nozzles will not fire (since up to eight nozzles in plate 52 are connected through a row/column multiplexing arrangement to a single interconnect pad 61) so that almost 10% of the dots would be missing in the printer output. The missing dot defect may be very noticeable because in one manifestation a blank line of eight spaces would occur with a frequency of approximately one line per a third of an inch in the media advance direction (Y direction).

FIG. 4*c* is a cross-sectional view along section A—A of FIG. 4*a* (i.e., in the X-direction of coordinate system 34). As seen in FIG. 4*c*, flex circuit 84 includes a flexible insulating tape 87 on which are formed interconnect pads 85. Flex circuit 84 is attached to print carriage 30 at end 91 by heat staking over plastic studs to form rivets and is clamped at end 92 with a printed circuit board (not shown) to print carriage 30.

Figure 4D:
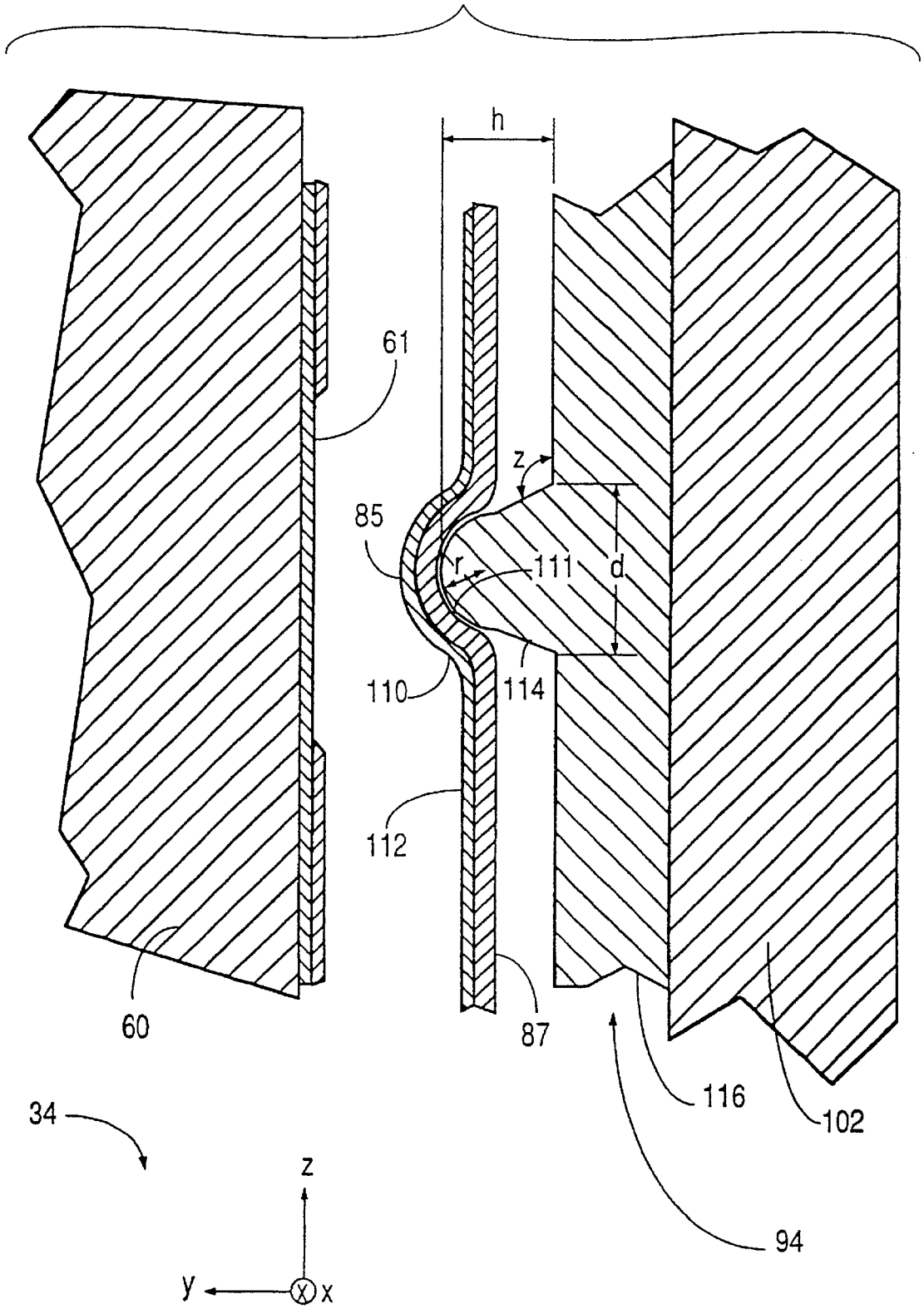
FIG. 4*d* is a cross-sectional view of the details of the interconnect area below the flex circuit of FIG. 4*c*.

FIG. 4*d* is a cross-sectional view of the details of the interconnect area around flex circuit 84 of FIG. 4*c*. As seen in FIG. 4*d*, flexible insulating tape 87 has raised bumps 110 on one side and corresponding dimples 111 on the other side. Interconnect pads 85 are formed on the raised bumps 110 of flexible insulating tape 87. Interconnect pads 85 are connected via conductive leads 112 formed on flexible insulating tape 87 to a printed circuit board (not shown) that supplies the electrical signals needed by heater resistors of the print cartridge 24, 26, 26 or 27 to vaporize the ink. Flexible insulating tape 87 could be made for instance of polyester film. Such a flexible insulating tape 87 and a printed circuit board can be made using conventional techniques.

Figure 5A:
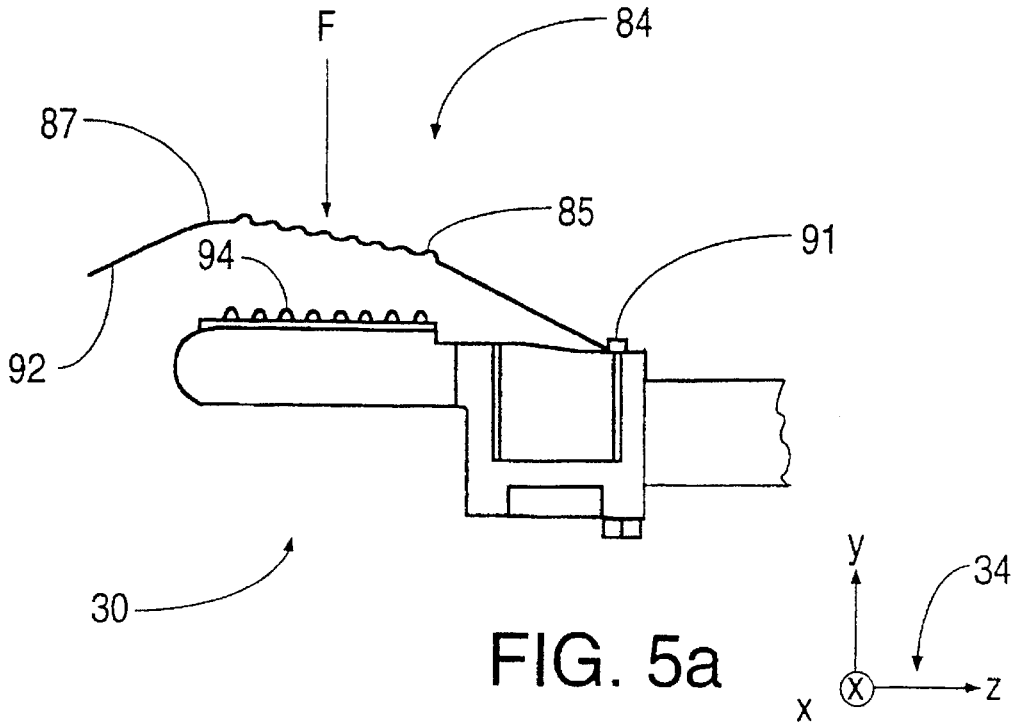
FIG. 5*a* is a cross-sectional view of the interconnect area of a print carriage showing details of the structure underlying the flex circuit of FIG. 4*a* in accordance with an embodiment of the invention.

FIG. 5*a* is a cross-sectional view of the interconnect area of print carriage 30 showing details of the structure underlying flex circuit 84 of FIG. 4*a* in accordance with an embodiment of the invention. As shown in FIG. 5*a*, a flexible insulating tape 87 is attached, by, for example, riveting, at one end 91 to the wall of the print carriage 30. The other end 92 of flexible insulating tape 87 is substantially unattached or free floating. Application of a force F by print cartridge 24 (not shown) to flexible insulating tape 87 does not result in buckling of flexible insulating tape 87 since slack in the tape is accommodated by free floating end 92. On the underside of flexible insulating tape 87 is an elastomeric compensator 94, a gimbal plate (not shown) and a spring (not shown) which urge the interconnect pads 85 on the print carriage 30 against corresponding interconnect pads 61 (FIG. 4*d*) on print cartridge 24, 25, 26 or 27.

Figure 5B:
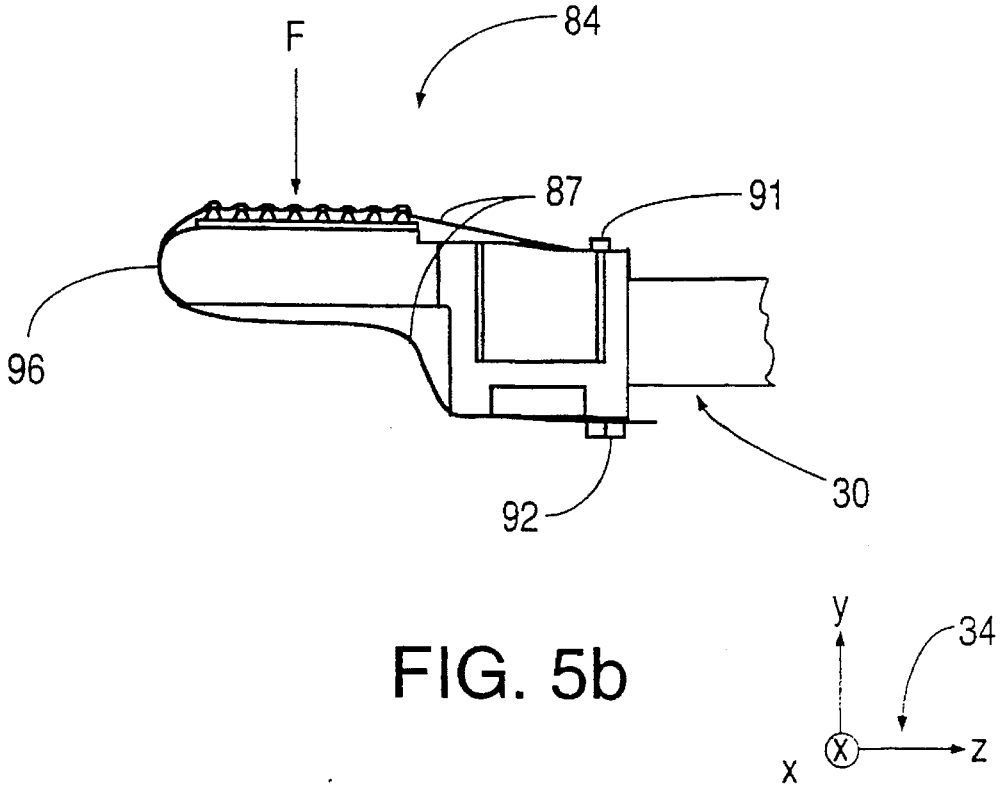
FIG. 5*b* is a cross sectional view of the interconnect area of the print carriage showing details of the structure underlying the flex circuit in accordance with another embodiment of this invention.

FIG. 5*b* is a cross sectional view of the interconnect area of a stall 64, 65, 66 or 67 of print carriage 30 showing details of the structure on the back side of flex circuit 84 in accordance with another embodiment of this invention. The end 91 of flexible insulating tape 87 is attached to a wall of stall 64, 65, 66 or 67 of print carriage 30. The opposite end 92 of flexible insulating tape 87 is bent around a U-shaped end of a portion 96 of print carriage 30 and is attached to an opposite side of the wall of stall 64, 65, 66 or 67. Application of force F does not result in buckling since slack in flexible insulating tape 87 is accommodated around the bend of portion 96 of the print carriage 30. Due to the friction between the print cartridge 24, 25, 26 or 27 and the flexible insulating tape 87, the slack in flexible insulating tape 87 is pushed into the bend so that the interconnect area between attachment 91 and interconnect pad 130 (FIG. 8*a*) is placed in tension, assuring that flexible insulating tape 87 does not buckle.

Figure 6A:
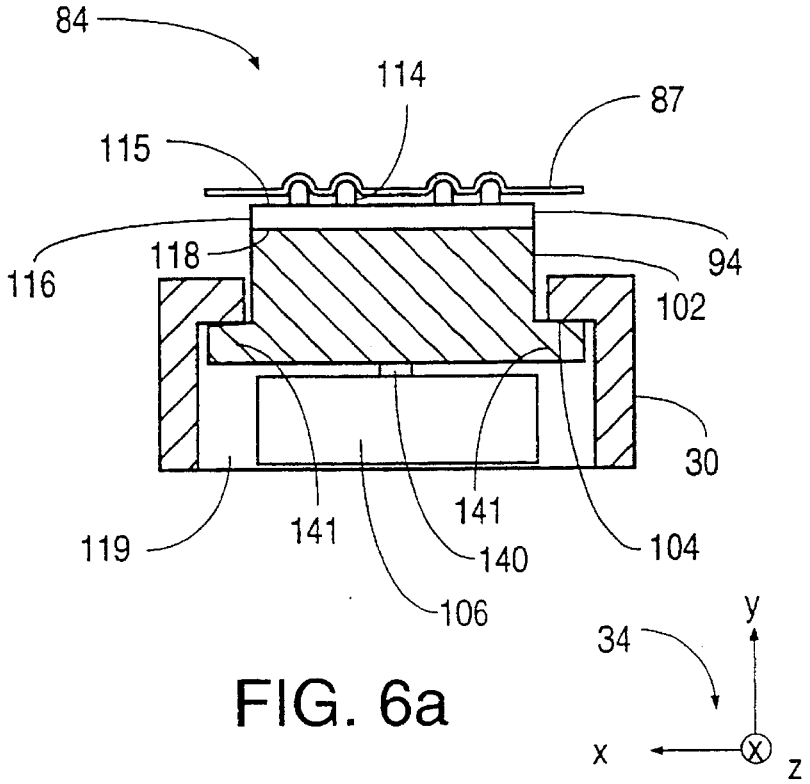
FIG. 6*a* is a cross-sectional end view (as seen in the Z-direction) of a flex circuit, an elastomeric compensator, a gimbal plate and a spring for use in the interconnect area of FIGS. 6*a* and 6*b*.
Figure 6B:
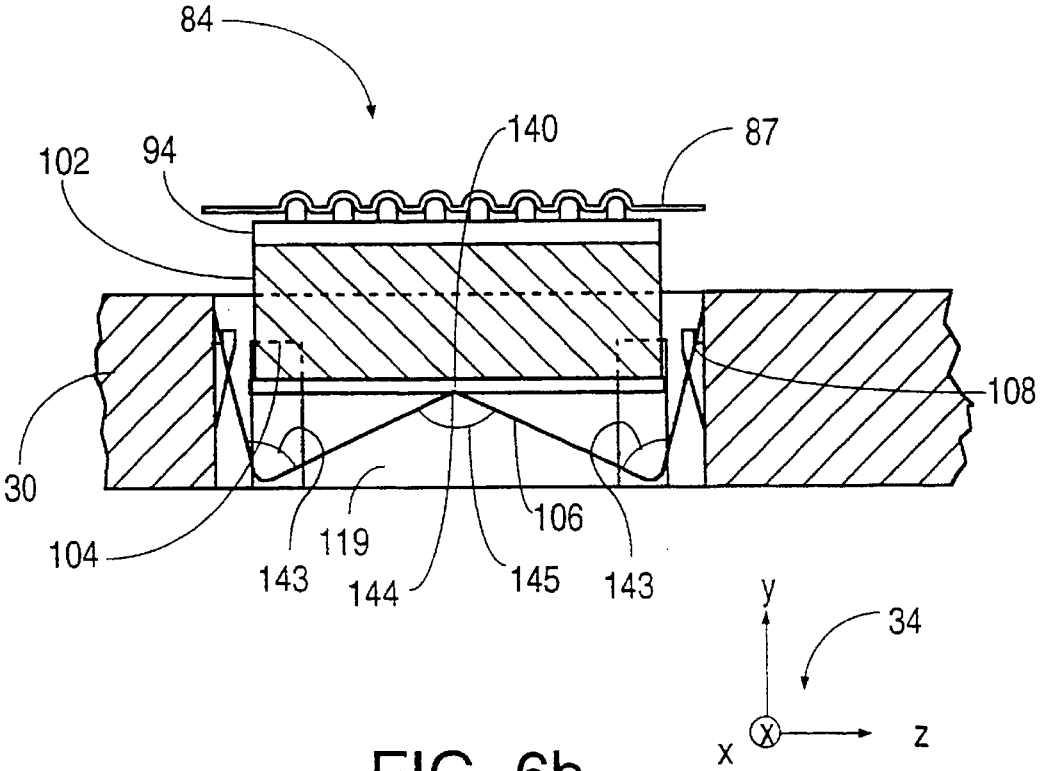
FIG. 6*b* is a cross-sectional side view (as seen in the X-direction) of the elements shown in FIG. 6*a*.
Figure 6C:
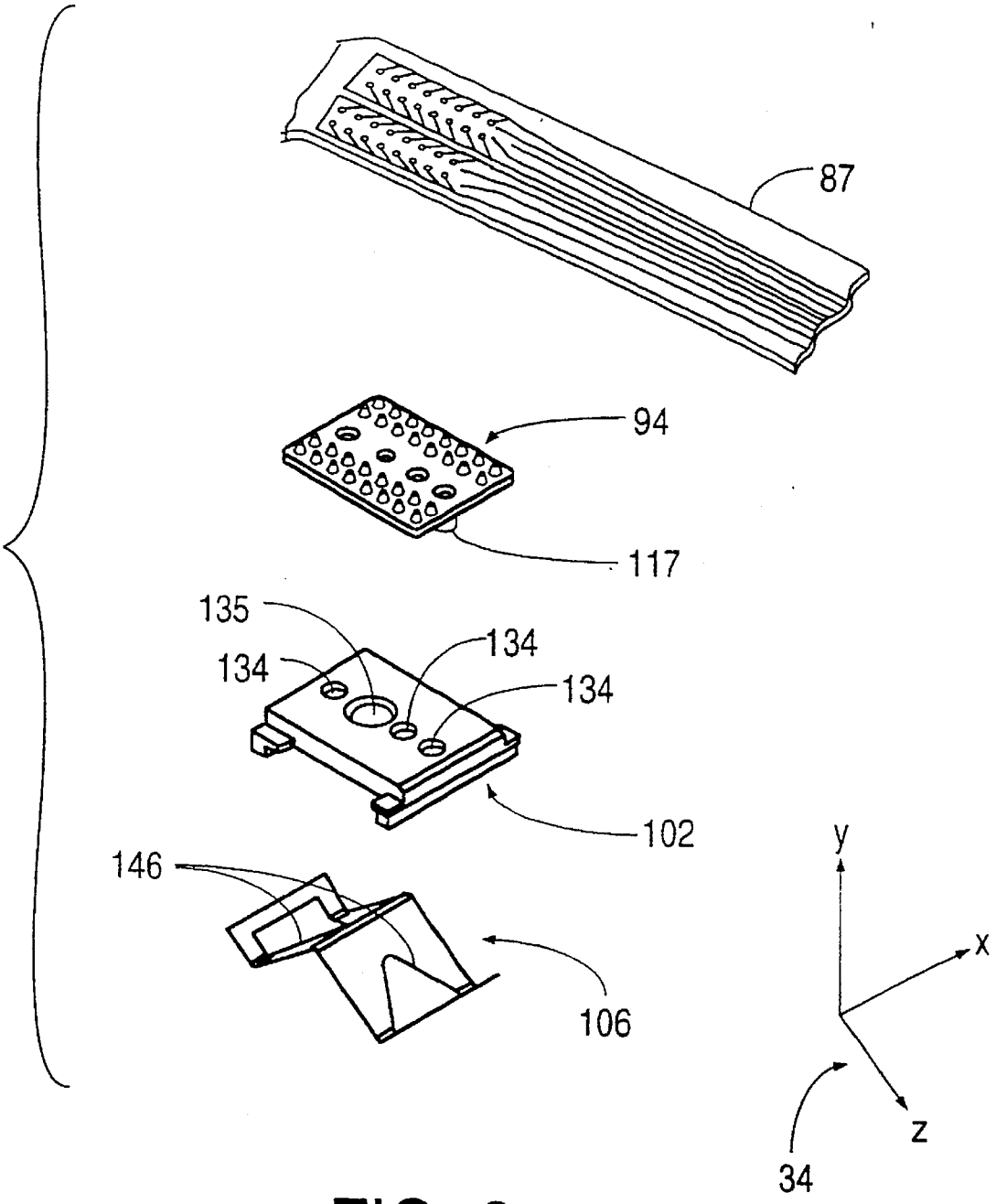
FIG. 6*c* is an exploded perspective view of the elements shown in FIGS. 6*a* and 6*b*.

FIG. 6*a* is a cross-sectional end view (as seen in the Z-direction) of a flex circuit 84, an elastomeric compensator 94, a gimbal plate 102 and a spring 106 for use in the interconnect area of FIGS. 6*a* and 6*b*. FIG. 6*b* is a cross-sectional side view (as seen in the X-direction) of the elements of FIG. 6*a*. FIG. 6*c* is an exploded perspective view of the elements shown in FIGS. 6*a* and 6*b*.

As shown in FIGS. 6*a* and 6*b*, elastomeric compensator 94 supports flexible insulating tape 87 of flex circuit 84. Elastomeric compensator 94 includes a base 116 of in one embodiment length 17 mm, width 12.5 mm, and thickness 2.5 mm. Elastomeric compensator 94 also includes columns 114 on side 115 facing flexible insulating tape 87. As seen better in FIG. 4*d*, each column 114 is tapered and has a hemispherical dome. In one embodiment, columns 114 have a taper z of 106°, a total height h of 1 mm, a base diameter d of 1.02 mm and a dome radius r of 0.30 mm. Therefore, the height of each column 114 of elastomeric compensator 94 is small compared to the median diameter of the column 114 (measured at half height) so that buckling of the columns 114 is minimized or eliminated.

Domes of the columns 114 of elastomeric compensator 94 are inserted into dimples 111 (FIG. 4*d*) on flexible insulating tape 87. Elastomeric compensator 94 is made of an elastically resilient, deformable material, preferably rubber. Since elastomeric compensator 94 is made of a resilient material, the columns 114 act to compensate for localized variations in the distance between the print carriage interconnect pads 85 and the print cartridge interconnect pads 61 i.e., pad-to-pad height variations on flexible insulating tape 87 and the print cartridge TAB circuit. On insertion of print cartridge 24, 25, 26 or 27 into a corresponding stall 64, 65, 66 or 67, the elastomeric compensator 94 is deformed about 0.5 mm.

As shown in FIGS. 6*a* and 6*b*, the side 118 of elastomeric compensator 94 opposite the side 115 facing the flexible insulating tape 87 is supported by a gimbal plate 102. Elastomeric compensator 94 has three protrusions 117 on side 118 (better shown in FIG. 6*c*) that are inserted into corresponding holes 134 (FIG. 6*c*) in gimbal plate 102. Protrusions 117 serve to hold elastomeric compensator 94 adjacent to and stationary relative to gimbal plate 102 and are sized appropriately to achieve that purpose and to assure correct orientation of elastomeric compensator 94 with respect to gimbal plate 102.

A gimbal plate 102 resides in chamber 119 (FIGS. 6*a* and 6*b*) of each stall 64, 65, 66 and 67 of print carriage 30. In chamber 119 gimbal, plate 102 rests on stops 104 prior to insertion of a print cartridge 24, 25, 26 or 27 into a corresponding stall 64, 65, 66 or 67. However, gimbal plate 102 gimbals within chamber 119 on insertion of a print cartridge 24, 25, 26 or 27. The gimbal motion of gimbal plate 102 is described in detail below. Gimbal plate 102 has a flat surface (FIG. 6*c*) on one side with three holes 134 to receive the corresponding protrusions 117 of elastomeric compensator 94. Central recess 135 is formed due to the gimbal injection molding process and is not necessary to practice this invention. The dimensions of the plate 102 and the dimensions of the holes 134 and recess 135 are not necessary to enable one skilled in the art to practice this invention. The other side of the gimbal plate 102 has a central ridge 140 and side stops 141 as shown in FIGS. 6*a* and 6*b*. Ridge 140 protrudes down 0.5 mm farther than the bottom of the gimbal plate 102 and bears on the spring 106. Ridge 140 of gimbal plate 102 allows gimbal Gimbal plate 102 to gimbal in the X direction. Plate 102 is preferably made of a non-deformable rigid material such as plastic by an injection molding process.

As shown in FIGS. 6*a* and 6*b*, a "W" shaped spring 106 supports gimbal plate 102 at ridge 140 of gimbal plate 102. When print cartridge 24, 25, 26 or 27 is inserted into a corresponding stall 64, 65, 66 or 67, the print cartridge 24, 25, 26 or 27 pushes the gimbal plate 102 away from the stops 104 such that gimbal plate 102 gimbals with respect to the print carriage 30 so that proper alignment between interconnect pads 61 on the print cartridge 24, 25, 26 or 27 will be made with interconnect pads 85 on the print carriage 30. Ridge 140 of gimbal plate 102 rests on the central inverted-V bend 144 of spring 106 so that there is sufficient clearance between side stops 141 of gimbal plate 102 and spring 106. The clearance between the side stops 141 and spring 106 permits gimbal plate 102 to gimbal in the Z direction.

One advantage of providing a ridge 140 instead of a central pivot point in gimbal plate 102 is that gimbal plate 102 can recover from a significant amount of sliding in the direction of the ridge 140 (the Z direction) when the external force changes. In a similar manner, the provision of a central inverted-V bend 144 along the length of spring 106 allows gimbal plate 102 to recover from a significant amount of sliding in the direction of the spring 106 length (the X direction).

Spring 106 is mounted on hooks 108 formed in the side walls of chamber 119 of print carriage 30. The gimbal plate 102 and the spring 106 allow a global redistribution of force on the interconnect pads 85 so that, if the plane of the interconnect pads 61 of the print cartridge 24, 25, 26 or 27 is at an angle with respect to the plane of the interconnect pads 85 of print carriage 30, the gimbal plate 102 and spring 106 help to equalize the force exerted on each print cartridge interconnect pad 61. Thus, if interconnect pads 61 of print cartridge 24, 25, 26 or 27 are not in a plane parallel to the interconnect pads 85 of print carriage 30, the gimbal structure of gimbal plate 102 and spring 106 allows the flex circuit 84 to rock over and make contact with interconnect pads 61 of print cartridge 24, 25, 26 or 27.

Figure 7:
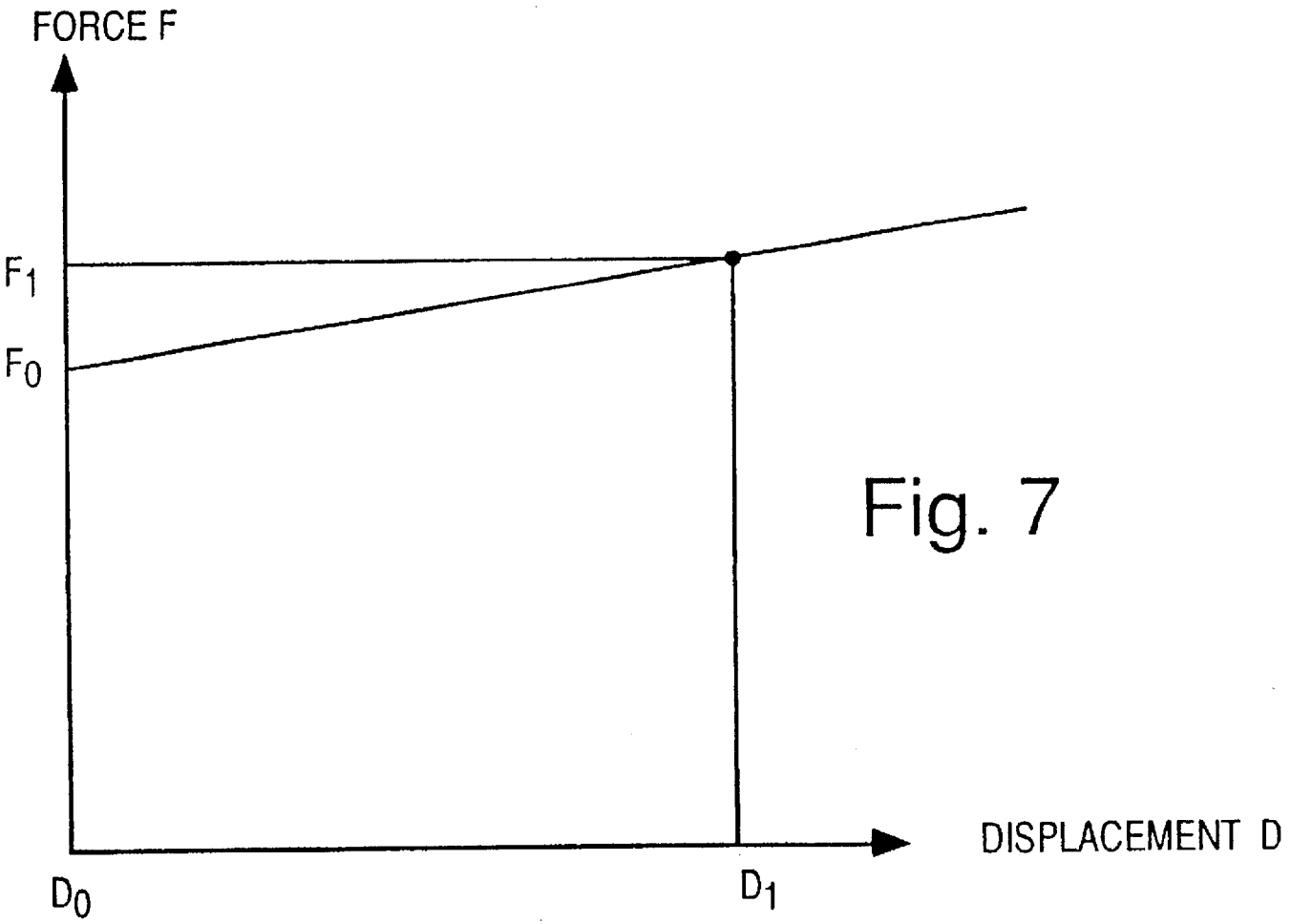
FIG. 7 is a force vs. displacement curve for the print carriage of this invention.

Yet another aspect of this invention is that spring 106 has a pre-loaded force when installed in print carriage 30 so that gimbal plate 102 contacts stops 104 of print carriage 30 with a sufficient force $F_o$ (FIG. 7) to make electrical interconnect between the print cartridge 24, 25, 26 or 27 and print carriage 30. FIG. 7 is a force vs. displacement curve for the print carriage 30 of this invention. In FIG. 7, the displacement D shown is the displacement of the gimbal plate 102. In FIG. 7, the force F shown is the contact force between the interconnect pads 85 of print carriage 30 and the interconnect pads 61 of print carriage 24, 25, 26 or 27. Elastomeric compensator 94 does not add to the total force F between the interconnect pads 85 and interconnect pads 61 since the elastomeric compensator 94 is supported entirely by gimbal plate 102 and spring 106. Thus, as shown in FIG. 7, a minimum force $F_0$ is guaranteed for even the smallest displacement of the gimbal plate 102. In order to generate force $F_o$ between interconnect pads 85 and interconnect pads 61, the elastomeric compensator 94 is deformed 0.5 mm on insertion of print cartridge 24, 25, 26 or 27.

Moreover, as shown in FIG. 7, the force supplied by spring 106 remains approximately constant ($F_o \approx F_1$) for a large variation in displacement ($D_1 - D_o$). The gimbal plate 102 and spring 106 provide the correct amount of force necessary for electrical contact between interconnect pads 85 and 61 in spite of a relatively large variation in displacement of print cartridge 24, 25, 26 or 27 with respect to stall 64, 65, 66 or 67. Therefore, even though over the life of a print carriage 30, a print cartridge 24, 25, 26 or 27 may press against a flex circuit 84 for a different amount of distance each time a different print cartridge 24, 25, 26 or 27 is inserted into a stall 64, 65, 66 or 67, on each insertion an approximately equal force $F_o \approx F_1$ is exerted between the interconnect pads 85 and corresponding interconnect pads 61.

Spring 106 also evens the force exerted on the interconnect pads 85 of print carriage 30 during insertion of print cartridge 24, 25, 26 or 27. Just before the print cartridge 24, 25, 26 or 27 is fully seated in print carriage 30, the farthest interconnect pads 130 (FIG. 8*a*) of the print carriage 30 are depressed by the print cartridge 24, 25, 26 or 27. The displacement of interconnect pads 130 is not significantly larger than the displacement of interconnect pads 132 since the gimbal plate 102 and spring 106 cause the interconnect pads between interconnect pads 130 and 132 of print carriage 30 to make contact with interconnect pads 61 on the print cartridge 24, 25, 26 or 27 as described below. Therefore, the force F between interconnect pads 61 and interconnect pads 85 can be optimized to perform the desired wiping function for scraping off contaminants (as described below) instead of force F being limited to the maximum load that the farthest interconnect pads 130 can withstand.

Spring 106 may be made of any material such that a shallow force curve is obtained for the equation $F=F_o+KX$ as shown in FIG. 7, wherein X is the relative displacement $D-D_o$. The spring constant K is sufficiently small so that $F \approx F_o$ in spite of a relatively large X. Such a spring 106 accommodates varying conditions and yet yields an adequate contact force F which is neither so large as to damage the interconnect pads 85 and 61 nor so small as to result in inadequate electrical contact between the interconnect pads 85 and 61. In the equation $F=F_o+KX$, the pre-load force $F_o$ ensures that there is adequate contact force F for even the smallest displacement ($D \approx D$).

In the preferred embodiment, spring 106 is made of stainless steel with a spring constant K=500 grams/mm and a preload force $F_o$ of about 900 grams (approximately 30 grams per interconnect pad). The spring has a width of approximately 12 mm. The farthest distance between the legs of the W shaped spring is approximately 22 mm. The angle 143 (FIG. 6*b*) is approximately 100°. The angle 145 of the central inverted-V bend 144 of spring 106 is approximately 106°. Central cutouts 146 (FIG. 6*c*) are provided to lower the spring constant K of spring 106 while ensuring an approximately constant stress throughout spring 106.

Figure 8A:
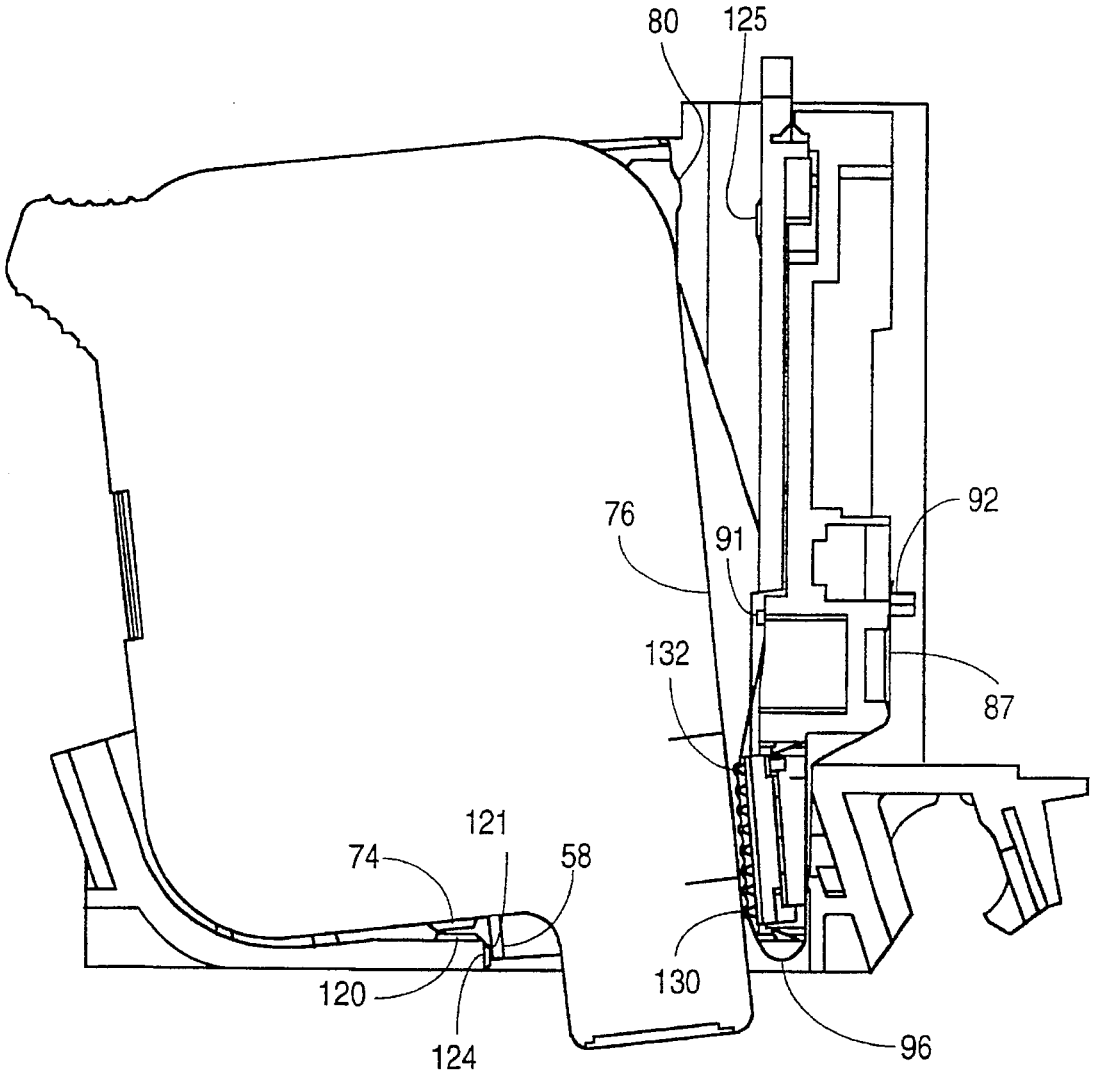
FIG. 8*a* is a cross-sectional view along section A—A of FIG. 4*a* (in the X-direction of coordinate system) showing the initial position of a print cartridge being inserted in a stall.
Figure 8A:
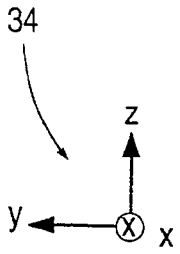

FIG. 8*a* is a cross-sectional view along section A—A of FIG. 4*a* (in the X-direction of coordinate system 34) showing the initial position of a print cartridge 24, 25, 26 or 27 on insertion in a stall 64, 65, 66, or 67. As shown in FIG. 8*a*, on initial insertion, print cartridge 24, 25, 26 or 27 is pushed all the way into a stall 64, 65, 66 or 67 of print carriage 30 in a linear motion until projection 74 of print cartridge 24, 25, 26, or 27 is constrained by projection 120 (better shown in FIG. 4*a*) of print carriage 30 in the Z direction. Print cartridge 24, 25, 26 or 27 is also substantially constrained in the X direction by projections 70 and 72 as well as by a resilient metal arm 68 (FIGS. 4*a* and 4*b*) in stall 64, 65, 66 or 67 that urges print cartridge 24, 25, 26 or 27 against a right wall 89 of the stall 64, 65, 66 or 67.

In the position of FIG. 8*a*, projection 58 of print cartridge 24, 25, 26 or 27 is in contact with projection 124 (also shown in FIG. 4*b*) of print carriage 30. Also, the farthest interconnect pads (such as pads 130 and adjacent pads) of the print carriage 30 are slightly depressed by the print cartridge 24, 25, 26 or 27 so that the print cartridge 24, 25, 26 or 27 is substantially stationary in the direction as well. The advantage of providing Y projection 58 opposite the interconnect pads 85 of the print carriage 30 is that the user need not overcome the contact force between the interconnect pads 85 and interconnect pads 61. Instead, the contact force is balanced by projection 58 coming in contact with projection 124.

In the position of FIG. 8*a*, the angle between surface 76 of the print cartridge 24, 25, 26 or 27 and the Z axis of the print carriage 30 is 6°. In reaching this position, any slack in flexible insulating tape 87 has been pushed out by print cartridge 24, 25, 26 or 27 into bend 96 of the print carriage 30. A friction force is exerted on the flex circuit 84 by print cartridge 24, 25, 26 or 27 as print cartridge 24, 25, 26 or 27 is inserted into print carriage 30. Since flexible insutating tape 87 is attached at end 91 (FIG. 4*a* ) to a wall of stall 64, 65, 66 or 67, flexible insulating tape 87 becomes flat and straight so that proper alignment between the interconnect pads 85 of print carriage 30 and interconnect pads 61 of print cartridge 24, 25, 26 or 27 will be made.

Figure 8B:
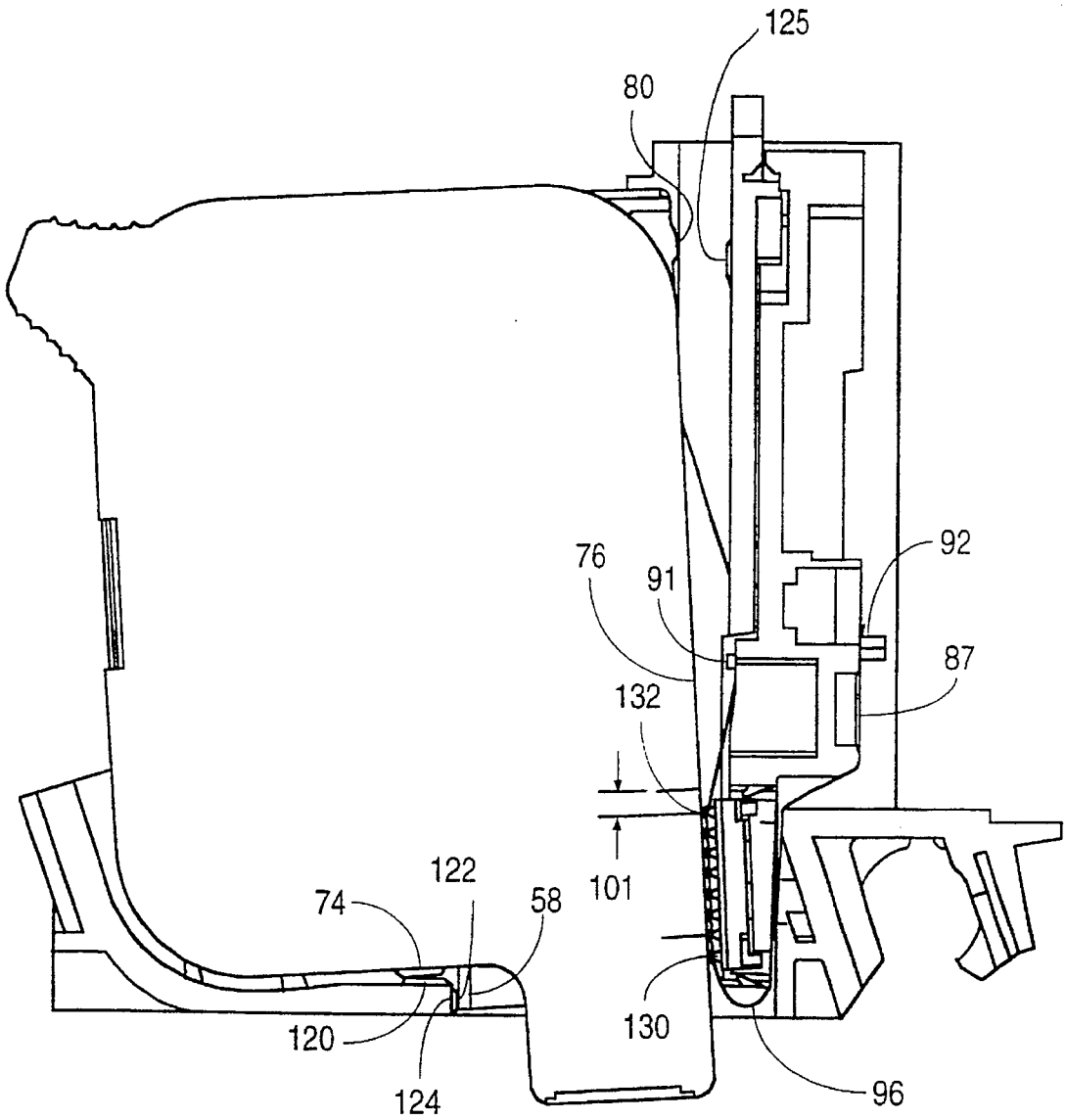
FIG. 8*b* is a cross-sectional view along section A—A of FIG. 4*a* (in the X-direction of coordinate system) showing the position of a print cartridge inserted in a stall a little farther than in FIG. 8*a*.
Figure 8B:
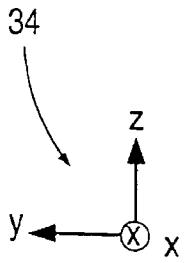

FIG. 8*b* is a cross-sectional view along section A—A of FIG. 4*a* (in the X-direction of coordinate system 34) showing the position of a print cartridge 24, 25, 26 or 27 inserted in a stall 64, 65, 66, or 67 a little farther than in FIG. 8*a*. To reach the position of FIG. 8*b*, print cartridge 24, 25, 26 or 27 is rotated around a pivot point 121 (FIG. 8*a*) on projection 124 of print carriage 30. Pivot point 121 is located at a radial distance of about 27 mm away from the plane of the interconnect pads 85. The large radial distance of the pivot point 121 from the interconnect pads 85 permits a significant amount of translation motion between the interconnect pads 85 and the interconnect pads 61 which in turn provides a large amount of wiping action to remove any contaminants (as described below).

In FIG. 8*b*, surface 76 of print cartridge 24, 25, 26 or 27 is at an angle of 4° with respect to the Z axis of the print carriage 30. In the position of FIG. 8*b*, flex circuit 84 (FIGS. 4*a* and 4*b*) has been displaced sufficiently by print cartridge 24, 25, 26 or 27 that gimbal plate 102 and spring 106 (FIGS. 4*c* and 4*d*) cause interconnect pads 85 on flex circuit 84 to rock over and make contact with interconnect pads 61 of print cartridge 24, 25, 26 or 27. As described above, the force supplied by gimbal plate 102 and spring 106 remains approximately constant ($F_o \approx F_1$) for a large variation in displacement ($D_1 - D_o$). Therefore gimbal plate 102 and spring 106 allow contact to be made between interconnect pads 85 and interconnect pads 61 in spite of a relatively large variation in displacement or angle of print cartridge 24, 25, 26 or 27 with respect to print carriage 30. The early contact between flex circuit 84 and the interconnect pads 61 of print cartridge 24, 25, 26 and 27 caused by gimbal plate 102 and spring 106 aids the wiping action as described below.

In the position in FIG. 8*b*, all the interconnect pads 85 between pads 130 and 132 are in contact with interconnect pads 61 of print cartridge 24, 25, 26 or 27 in the Y direction. However, the interconnect pads 85 and the interconnect pads 61 do not correspond to each other since the print cartridge 24, 25, 26 or 27 and the print carriage 30 are not in alignment. There is about 2.174 mm distance (dimension 100) along the Z direction between interconnect pads 85 and corresponding interconnect pads 61 that is yet to be covered before the interconnect pads 85 contact corresponding interconnect pads 61.

Figure 8C:
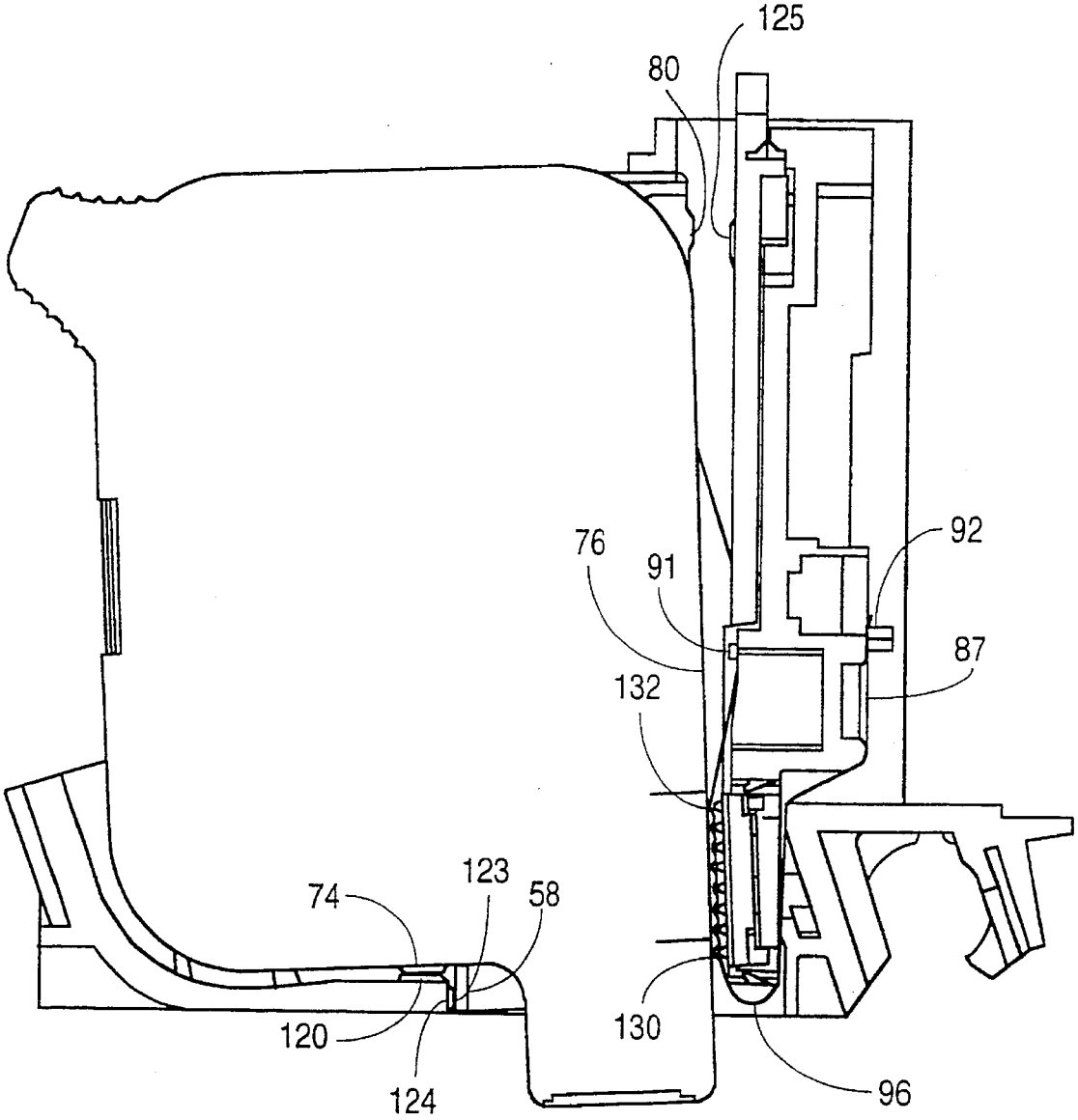
FIG. 8*c* is a cross-sectional view along section A—A of FIG. 4*a* (in the X-direction of coordinate system) showing the position of a print cartridge inserted in a stall a little farther than in FIG. 8*b*.
Figure 8C:
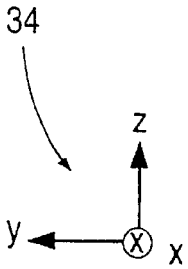

FIG. 8*c* is a cross-sectional view along section A—A of FIG. 4*a* (in the X-direction of coordinate system 34) showing the position of a print cartridge 24, 25, 26 or 27 inserted in a stall 64, 65, 66, or 67 a little farther than in FIG. 8*b*. In FIG. 8*c*, print cartridge 24, 25, 26 or 27 is shown inserted further than in FIG. 8*b* such that surface 76 of print cartridge 24, 25, 26 or 27 is at an angle of 2° with respect to the Z axis of the print carriage 30. To reach the position in FIG. 8*c*, the pivot point on projection 124 moves to pivot 122 (point FIG. 8*b*), an inward position from pivot point 121, as the print cartridge 24, 25, 26 or 27 rotates in print carriage 30. Although there is a rotating motion overall, there is a sliding motion between the interconnect pads 61 of the print cartridge 24, 25, 26 and 27 and the interconnect pads 85 of the print carriage 30. While reaching the position in FIG. 8*c*, due to the sliding motion and due to the contact force exerted by spring 106, a wiping action for a large distance (over 1 mm) at a uniform force (approximately 900 grams) takes place between interconnect pads 61 and interconnect pads 85. In the position shown in FIG. 8*c*, there is still over 1 mm distance in the Z direction between interconnect pads 61 of the print cartridge 24, 25, 26 and 27 and the corresponding interconnect pads 85 of print carriage 30.

Figure 8D:
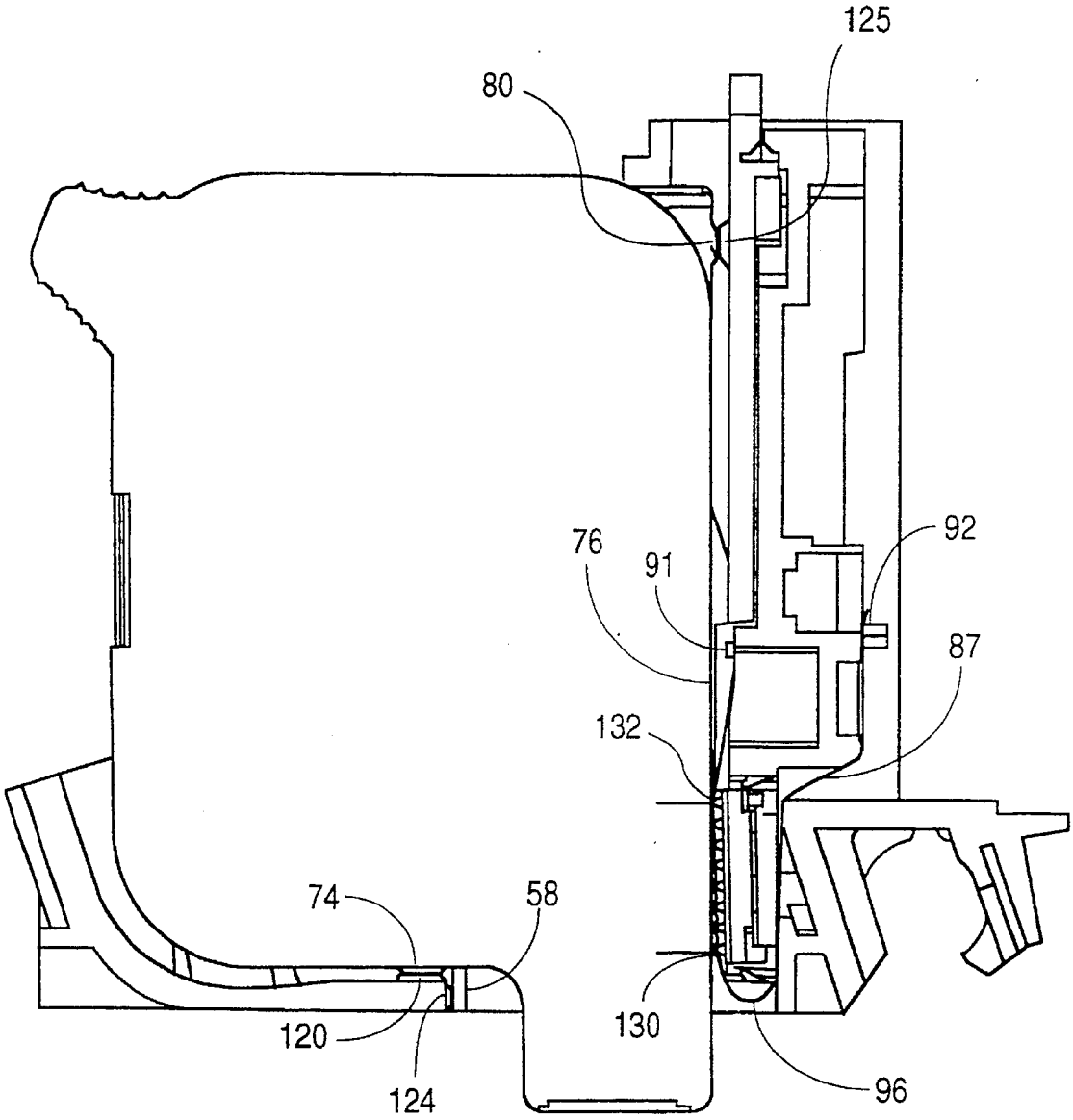
FIG. 8*d* is a cross-sectional view along section A—A of FIG. 4*a* (in the X-direction of coordinate system) showing the final position of a print cartridge inserted in a stall of the print carriage.
Figure 8D:
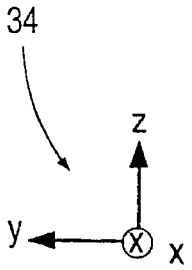

FIG. 8*d* is a cross-sectional view along section A—A of FIG. 4*a* (in the X-direction of coordinate system 34) showing the final position of a print cartridge 24, 25, 26 or 27 inserted in a stall 64, 65, 66, or 67 of the print carriage 30. In the final position of FIG. 8*d*, projection 58 is flush with projection 124. Also surface 76 is parallel with the Z axis and projection 80 is in contact with projection 125 on the floor of the stall 64, 65, 66 or 67 of the print carriage 30. In reaching the final position of FIG. 8*d*, the pivot point on projection 124 moves to pivot point 123 (FIG. 8*c*), an inward position from pivot point 122y, as the print cartridge 24, 25, 26 or 27 rotates in print carriage 30. The total movement of the pivot point from pivot point 121 (FIG. 8*a*) to pivot point 123 (FIG. 8*c*) is about 0.08 mm.

While reaching the final position of FIG. 8*d* from the position in FIG. 8*c*, additional wiping action for a distance of over 1 mm at a uniform force of 1000 grams takes place between the interconnect pads 61 and interconnect pads 85. In the final position, the interconnect pads 61 on the print cartridge 24, 25, 26, or 27 and the corresponding interconnect pads 85 on the print carriage 30 are in proper alignment with each other in each of the X, Y and Z directions.

Therefore, in this invention, a wiping action for a total distance of about 2.174 mm at about 1000 grams force is provided between the print cartridge interconnect pads 61 and the print carriage interconnect pads 85 in the Z direction. Due to this large wiping action at a force uniform spatially across interconnect pads 85 any corrosion on or contaminants between the interconnect pads 85 and 61 should be wiped away. Therefore the final position of the print cartridge 24, 25, 26 or 27 results in adequate electrical contact between the print cartridge interconnect pads 61 and print carriage interconnect pads 85 irrespective of the Y direction displacement or angular variation of the interconnect pads 61 on print cartridge 24, 25, 26 or 27.

One drawback of the above technique is that on repeated insertions of print cartridge 24, 25, 26 or 27 into the print carriage 30, the interconnect pads 85 and the interconnect pads 61 start wearing out due to the sliding motion and the contact force between the interconnect pads 85 and the interconnect pads 61. In one embodiment, the interconnect pads 61 of the print cartridge 24, 25, 26 or 27 are made of a softer material while the interconnect pads 85 of the print carriage 30 are made of a harder material so that the interconnect pads 61 of the disposable print cartridge 24, 25, 26 or 27 are the ones that are worn out first. In the preferred embodiment, a gold surface of 200 to 240 knoop hardness is used for the interconnect pads 65 of print carriage 30 and a gold surface of 40 to 90 knoop for the interconnect pads 61 of print cartridge 24, 25, 26 or 27.

The large amount of wiping action of the print cartridges 24, 25, 26, and 27 described above solves the "missing dot" problem.

Also, due to the provision of the projections within the width of portion 76 of print cartridge 24, 25, 26 or 27, the full width of the front surface of portion 76 of print cartridge 24, 25, 26 or 27 on which interconnect pads 61 are mounted (FIG. 3*b*) is available for positioning interconnect pads 61. The larger width allows interconnect pads 61 to be bigger in size so that a better electrical contact is obtained with corresponding interconnect pads 85 of the print carriage 30. The bigger size of the interconnect pads 61 permits larger manufacturing tolerances. Another advantage of a large width of portion 76 being available is that a uniform force distribution between interconnect pads 61 and interconnect pads 85 is easily achieved although portion 76 is prone to sinking during the injection molding process as described above in reference to FIG. 3*c*.

Accordingly, a novel flexible electrode structure and a method for ensuring electrical contact between interconnect pads of a print cartridge and a print carriage have been described in detail.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention. For example, instead of providing the flexible insulating tape 87 with a U-shaped bend as described above, an L-shaped bend may be provided without deviating from the spirit of this invention. Also, the elastomeric compensator and the spring may be installed in the print cartridge instead of or in addition to the print carriage. Moreover, instead of a spring, a separate gimbal structure and a conventional spring may be used. Numerous other variations are possible in flexible electrode structures and methods for ensuring electrical contact between the interconnect pads of a print carriage and a print cartridge, all of which are included within the broad scope of this invention.

What is claimed is:

1. An apparatus for use with a printer, comprising:

a print carriage; and a flexible insulating tape, said flexible insulating tape having a plurality of electrically conductive interconnect pads formed on a side of said flexible insulating tape so that said interconnect pads face away from said print carriage, said flexible insulating tape having a first end attached to said print carriage, a remaining portion of said flexible insulating tape being substantially unattached to the print carriage, said flexible insulating tape having a second end opposite said first end, said second end being substantially free floating.

2. An apparatus for use with a printer, comprising:

a print cartridge; and a flexible insulating tape, said flexible insulating tape having a plurality of electrically conductive interconnect pads formed on a side of said flexible insulating tape so that said interconnect pads face away from said print carriage, said flexible insulating tape having a first end attached to said print carriage, a remaining portion of said flexible insulating tape being substantially unattached to the print carriage, said flexible insulating tape having a second end opposite said first end, said second end being substantially free floating, said flexible insulating tape being bent around a portion of said print carriage such that a slack is provided in said flexible insulating tape, wherein said slack is located around said portion.

3. An apparatus for use with a printer, comprising:

a print carriage; and a flexible insulating tape, a plurality of electrically conductive interconnect pads formed on a side of said flexible insulating tape so that said interconnect pads face away from said print carriage, said flexible insulating tape having a first end attached to said print carriage; and a print cartridge, said print cartridge including a plurality of electrically conductive interconnect pads, wherein substantially all of said plurality of interconnect pads of said print cartridge are in electrical contact with corresponding interconnect pads of said flexible insulating tape;

wherein:

said flexible insulating tape is bent around a portion of said print carriage such that a slack is provided in said flexible insulating tape; and said slack is located around said portion.

4. An apparatus for use with a printer, comprising:

a print carriage having a first side and a second side; and a flexible insulating tape having a first end and a second end opposite said first end, a plurality of electrically conductive interconnect pads formed on a side of said flexible insulating tape facing away from said print carriage, wherein:

said first end of said flexible insulating tape is attached to said first side of said print carriage;

said second end of said flexible insulating tape is attached to said second side of said print carriage;

an intermediate portion of said flexible insulating tape is substantially unattached; and wherein said second side of said print carriage is at an angle of 180° with respect to said first side of said print carriage.

5. The apparatus of claim 4, wherein:

said flexible insulating tape is bent around a portion of said print carriage such that a slack is provided in said flexible insulating tape; and said slack is located around said portion of said print carriage.

6. A method for establishing electrical contact between electrically conductive interconnect pads on a print cartridge and corresponding electrically conductive interconnect pads on a print carriage when said print cartridge is installed in said print carriage, said method comprising the steps of:

attaching one end of a flexible insulating tape to said print carriage at a position on the print carriage upstream of the print carriage interconnect pads, the print carriage interconnect pads being formed on a surface of said flexible insulating tape;

such that a remaining portion of said flexible insulating tape remains substantially unattached; and tensioning the remaining portion of said flexible insulating tape extending from said one end by inserting the print cartridge into the print carriage.

7. A method for establishing electrical contact between electrically conductive interconnect pads on a print cartridge and corresponding electrically conductive interconnect pads on a print carriage when said print cartridge is installed in said print carriage, said method comprising the steps of:

attaching one end of a flexible insulating tape to said print carriage, the print carriage interconnect pads being formed on a surface of said flexible insulating tape;

such that a remaining portion of said flexible insulating tape remains substantially unattached; and bending said tape around an end of said print carriage.

8. A method for establishing electrical contact between electrically conductive interconnect pads on a print cartridge and corresponding electrically conductive interconnect pads on a print carriage when said print cartridge is installed in said print carriage, said method comprising the steps of:

providing a carriage stall in said print carriage for receiving a print cartridge;

attaching a first end of a flexible insulating tape to a first side of said print carriage at a position on the print carriage extending adjacent to said a carriage stall, said print carriage interconnect pads being formed on a surface of said flexible insulating tape;

attaching a second end of said flexible insulating tape to a second side of said print carriage such that an intermediate portion of said flexible insulating tape remains substantially unattached;

providing a slack in said intermediate portion of the flexible insulating tape; and tensioning the intermediate portion of the flexible insulating tape extending from said one end by inserting the print cartridge into said carriage stall to push the slack away from the print carriage interconnect pads.

9. A method for establishing electrical contact between electrically conductive interconnect pads on a print cartridge and corresponding electrically conductive interconnect pads on a print carriage when said print cartridge is installed in said print carriage, said method comprising the steps of:

attaching a first end of a flexible insulating tape to a first side of said print carriage, said print carriage interconnect pads being formed on a surface of said flexible insulating tape; and attaching a second end of said flexible insulating tape to a second side of said print carriage such that an intermediate portion of said flexible insulating tape remains substantially unattached;

wherein said second side of said print carriage is at an angle of 180° with respect to said first side of said print carriage.

10. A method for establishing electrical contact between electrically conductive interconnect pads on a print cartridge and corresponding electrically conductive interconnect pads on a print carriage when said print cartridge is installed in said print carriage, said method comprising the steps of:

attaching a first end of a flexible insulating tape to a first side of said print carriage, said print carriage interconnect pads being formed on a surface of said flexible insulating tape;

attaching a second end of said flexible insulating tape to a second side of said print carriage such that an intermediate portion of said flexible insulating tape remains substantially unattached;

wherein a slack is provided in said flexible insulating tape; and pushing the slack in said flexible insulating tape into a bend around an end of said print carriage.

11. The method of claim 8, further comprising the step of sliding said print cartridge interconnect pads against said print carriage interconnect pads.

12. A method for establishing electrical contact between-electrically conductive interconnect pads on a print cartridge and corresponding electrically conductive interconnect pads on a print carriage when said print cartridge is installed in said print carriage, said method comprising the steps of:

attaching a first end of a flexible insulating tape to a first side of said print carriage, said print carriage interconnect pads being formed on a surface of said flexible insulating tape;

attaching a second end of said flexible insulating tape to a second side of said print carriage such that an intermediate portion of said flexible insulating tape remains substantially unattached;

sliding said print cartridge interconnect pads against said print carriage interconnect pads;

wherein a slack is provided in said flexible insulating tape; and pushing the slack in said flexible insulating tape into a bend around an end of said print carriage, a direction of said pushing step being substantially the same as a direction of said sliding step.

13. An apparatus for use with a printer, comprising:

a print cartridge comprising:

(i) a first projection; and (ii) a plurality of electrically conductive interconnect pads; and a print carriage comprising:

(i) a second projection; and (ii) a flexible insulating tape, a plurality of electrically conductive interconnect pads being formed on a surface of said flexible insulating tape, wherein:

initial insertion of said print cartridge into said print carriage in an insertion direction is constrained by said first projection contacting said second projection;

further insertion of said print cartridge causes said print cartridge interconnect pads to contact said flexible insulating tape interconnect pads; wherein said flexible insulating tape is connected to said print carriage at a position upstream of the insertion direction additional insertion of said print cartridge causes tensioning of the flexible insulation tape and sliding of said print cartridge interconnect pads against said flexible insulating tape interconnect pads into alignment in a first direction.

14. The apparatus of claim 13, wherein:

said print carriage further comprises a third projection; and said additional insertion causes said print cartridge to rotate around a pivot point on said third projection.

15. The apparatus of claim 14, wherein said pivot point moves on said third projection.

16. The apparatus of claim 13, wherein said plurality of interconnect pads of said print cartridge are made of a material softer than the material used for making said plurality of interconnect pads of said flexible insulating tape.

17. The apparatus of claim 13, wherein:

said flexible insulating tape has a first end attached to said print carriage;

a substantially unattached bend is formed in said flexible insulating tape; and the first direction of said sliding motion is substantially the same as a direction extending from said first end toward said bend.

* * * * *